US012102867B1

(12) United States Patent
Linde

(10) Patent No.: US 12,102,867 B1
(45) Date of Patent: Oct. 1, 2024

(54) MULTI-USE FITNESS DEVICE AND METHOD

(71) Applicant: Ashford Fitness LLC, Hartsdale, NY (US)

(72) Inventor: Jason Linde, Hartsdale, NY (US)

(73) Assignee: Ashford Fitness LLC, Hartsdale, NY (US)

( * ) Notice: Subject to any disclaimer, the term of this patent is extended or adjusted under 35 U.S.C. 154(b) by 0 days.

(21) Appl. No.: 17/406,360

(22) Filed: Aug. 19, 2021

Related U.S. Application Data

(60) Provisional application No. 63/067,488, filed on Aug. 19, 2020.

(51) Int. Cl.
*A63B 21/00* (2006.01)

(52) U.S. Cl.
CPC ..... *A63B 21/154* (2013.01); *A63B 21/4035* (2015.10)

(58) Field of Classification Search
CPC . A63B 21/04; A63B 21/0407; A63B 21/0414; A63B 21/062; A63B 21/0626; A63B 21/078; A63B 21/15; A63B 21/151; A63B 21/154; A63B 21/1645; A63B 21/169
See application file for complete search history.

(56) References Cited

U.S. PATENT DOCUMENTS 2,977,120 A * 3/1961 Morris ..... A63B 21/156 482/103
3,438,627 A * 4/1969 Lanne ..... A63B 21/156 482/103
4,402,504 A * 9/1983 Christian ..... A63B 21/156 482/129
4,632,388 A * 12/1986 Schleffendorf ..... A63B 21/06 482/102
4,907,798 A * 3/1990 Burchatz ..... A63B 21/154 482/99
5,050,869 A * 9/1991 Frate ..... A63B 21/154 482/904
5,158,520 A * 10/1992 Lemke ..... A63B 21/06 482/133
6,015,371 A * 1/2000 Davitt ..... A63B 21/0552 482/129
6,142,919 A * 11/2000 Jorgensen ..... A63B 21/154 482/904
6,319,179 B1 * 11/2001 Hinds ..... A63B 21/156 482/121
6,669,609 B2 * 12/2003 Gerschefske ..... A63B 21/4007 482/130

(Continued)

*Primary Examiner* — Zachary T Moore
(74) *Attorney, Agent, or Firm* — PEARL COHEN ZEDEK LATZER BARATZ LLP

(57) ABSTRACT

An exercise device uses a vertically oriented member with multiple sheaves. Each sheave may be disposed around three different heights of the vertical member. A first sheave may be disposed substantially at a first end of the member. A second sheave may be disposed substantially at second end of the member. A third sheave may be disposed substantially at the center of the member. A flexible line may be connected to a weight at one end of the line, and the flexible line is then threaded through at least two of the first sheave, second sheave or third sheave.

16 Claims, 23 Drawing Sheets

(56) References Cited

U.S. PATENT DOCUMENTS

| | | | | |
|---|---|---|---|---|
| 7,172,538 | B2 * | 2/2007 | Keiser | A63B 21/00069 482/907 |
| 8,485,951 | B1 * | 7/2013 | Adams | A63B 21/00072 482/904 |
| 9,028,381 | B2 * | 5/2015 | Mestemaker | A63B 21/154 482/130 |
| 11,083,933 | B1 * | 8/2021 | Wilder | A63B 21/068 |
| 11,123,596 | B2 * | 9/2021 | Robinson | A63B 23/03525 |
| 2003/0069112 | A1 * | 4/2003 | Williams | A63B 21/156 482/99 |
| 2013/0035220 | A1 * | 2/2013 | Adams | A63B 21/4035 482/129 |
| 2013/0288861 | A1 * | 10/2013 | Cole | A63B 21/0618 482/102 |
| 2021/0353995 | A1 * | 11/2021 | Erb | A63B 21/062 |
| 2022/0054878 | A1 * | 2/2022 | Thach | A63B 21/156 |

* cited by examiner

MULTI-USE FITNESS DEVICE AND METHOD

CROSS-REFERENCE TO RELATED APPLICATION

This application claims the benefit of U.S. Provisional Patent Application No. 63/067,488, which was filed on Aug. 19, 2020, is entitled "WOOD AND ROPE BASED FITNESS DEVICE AND METHOD", and which is hereby incorporated by reference herein in its entirety.

FIELD OF THE INVENTION

This application relates to exercise devices or equipment. Specifically, this application relates to cable-based weight resistance exercise equipment using pulleys.

BACKGROUND

With the increasing number of people looking for exercise and physical therapy solutions outside of a populated fitness or training center, there are limited solutions for home installations. Although there is a wide selection of cable-based fitness machines, most are very large and commercial feeling or are generally intended to be concealed when not in use. The complexity and size of current solutions make it unreasonable for the average consumer to obtain and install such cable-based devices.

Therefore, it would be desirable to provide a cable-based weight resistance exercise device which is compact, minimal in design, cost effective, and aesthetically complimentary to residential spaces.

SUMMARY

Embodiments may include an exercise device including a vertically oriented member with a first sheave disposed substantially at a first end of the member, a second sheave disposed substantially at second end of the member, and a third sheave disposed substantially at the center of the member. A flexible line may be connected to a weight at one end of the line, and may be threaded through at least two of the first sheave, second sheave or third sheave.

Embodiments may enable strength training and physical therapy cable and physical therapy cable exercises to be performed on a minimal and aesthetically refined system. By the use of uncommon materials such as wood and a flexible line such as a braided rope, embodiments offer a fitness solution that more easily integrates into residential interiors. A counterweight resistance exercise device according to some embodiments can utilize for example, two vertically oriented parallel post members, mechanically fastened to for example, both the floor and ceiling. Rotating pulleys or sheaves, mounted between the posts at fixed heights, may guide or position a flexible line or tension cable in specific configurations to allow one to lift the counterweights via interchangeable handles or attachments.

Embodiments may feature the intentional use of aesthetically pleasing materials and textures. The structure of the system as well as the handles of the accessories are predominantly solid wood. The flexible lines or tension cables connecting these accessory handles to the counterweights may be predominantly colorful braided rope. These attributes may allow the system to be warm and attractive while also being highly functional and efficient.

Embodiments may be integrated into both home fitness rooms as well as installed within multi-function residential spaces such as living rooms, bedrooms and open plan living areas.

Prior art exercise or gym systems may require the use of many different weights which are selected using a selector pin. Embodiments of the present invention allow the fastening of any individual weight or combination of weights to a line, to change the weight used with the system, and use any weight that can be attached to a line, such as a dumbbell. Thus some embodiments may be more flexible and compact compared to prior systems. Prior art exercise systems may include adjustable wheels set by pin; embodiments of the present invention may obviate this need by using lines or ropes of adjustable size which, in combination with the ability to have the line threaded through different combinations of pulleys, can raise or lower the height at which a handle or user grip is provided to a user, allowing for multiple exercises to be performed with one device. Prior art systems do not allow a user to alter the threading of lines through the mechanism. Embodiments of the present invention present a simple device requiring no grease or ball bearings, with less need for service than with prior devices.

Embodiments of the present invention may provide a system that is able to be stripped down more than prior art systems, in the sense that embodiments may allow for all weights, attachment mechanisms and ropes to be easily removed, leaving the resulting device almost bare and visually minimal when not in use. In some embodiments, to change handle or accessory heights, the ropes or lines may be changed (e.g. swapped out) or connected together, which reduces moving parts and complex components compared with prior art systems. Embodiments may be compatible with and use standard or Olympic sized weight plates with no restriction in size as the plates may hang behind the posts.

BRIEF DESCRIPTION OF THE DRAWINGS

Non-limiting examples of embodiments of the disclosure are described below with reference to figures attached hereto. Dimensions of features shown in the figures are chosen for convenience and clarity of presentation and are not necessarily shown to scale. The subject matter regarded as the invention is particularly pointed out and distinctly claimed in the concluding portion of the specification. The invention, however, both as to organization and method of operation, together with objects, features and advantages thereof, can be understood by reference to the following detailed description when read with the accompanied drawings. Embodiments of the invention are illustrated by way of example and not limitation in the figures of the accompanying drawings, in which like reference numerals indicate corresponding, analogous or similar elements, and in which:

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as not to obscure the present invention.

Figure 1:
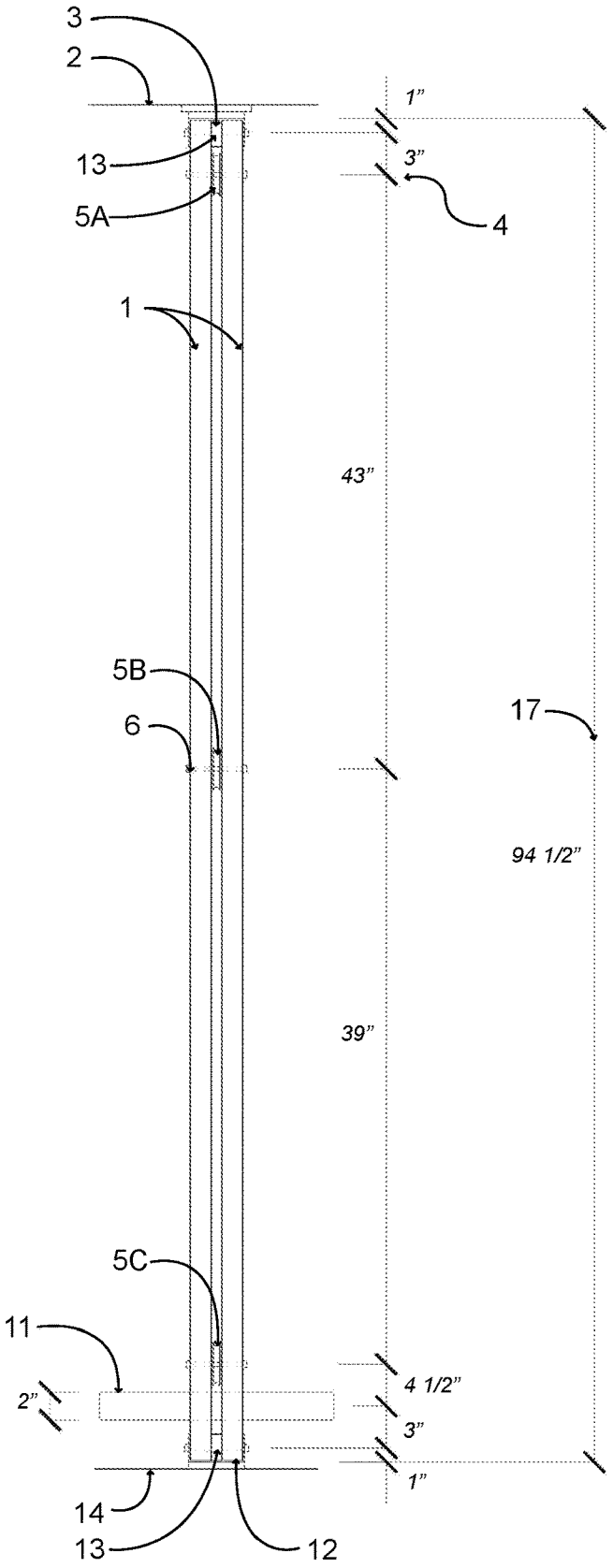
FIG. 1 is a front elevation view of an exercise system assembly according to embodiments of the present invention.

FIG. 1 is a front elevation view of an example embodiment of an exercise system assembly according to embodiments of the present invention. The core elements include vertical members or posts, which may include sub-members, e.g. two vertically oriented sub-members 1' may form a vertical member 1. The vertical member 1 or sub-members 1' may be, for example, any suitable material providing ample support and strength e.g. wood; e.g. the vertical members may be primarily or substantially wood. For example, two pieces of lumber having the size of 1"×6" or 2"×4" may be used. As with other specific sample dimensions discussed herein, other dimensions may be used. Lumber of this size may prevent the carabiners on one side of a vertical member from bumping into pulleys on other side, by distancing the travel of the carabiner from pulleys; and lumber of this size may require two horizontally spaced carabiners near the top of the equipment. The vertical member 1 may be mechanically bound, e.g. connected together, for example by a floor bracket assembly 12 and a ceiling mounting bracket assembly 3. Vertical member 1 may be cut to the length of a floor 14 to a ceiling 2, typically for residential homes, a length of 8' is suitable, other longer or shorter lengths may be used.

Three rotating sheaves or pulleys 5A-5C (or groups of such sheaves or pulleys) with internal bearings may be mechanically mounted between the vertical sub-members 1' via for example connecting bolts 6. The connecting bolts 6 may be configured to penetrate through the vertical member 1 and fit within the internal bearings of sheaves 5A-5C and may dispose the sheaves substantially at different heights, mounting the sheaves 5A-5C to the vertical member 1. Sheaves or pulleys 5A-5C may be fixed in place, and not moveable by a user. Sheaves 5A-5C may be individual sheaves or pulleys, or a group of more than one sheave, e.g. a pulley group or a sheave group wherein at least two sheaves are disposed, and typically mounted permanently, substantially at or near a specific height. For example, a first sheave or sheave group 5C may be disposed substantially at a first end near the floor of the vertical member 1, e.g. approximately (e.g. +−10%) 5% of the way above the lower/floor end of the device, or approximately 5 inch(es) from the floor. The sheave position is described with respect to the center of the sheave, each sheave may have varying diameters, where the position of the sheave may depend on its size and diameter, e.g. a sheave with a larger diameter may be disposed approximately (e.g. +−10%) 10% of the way above the lower/floor end of the device (e.g. approximately 10 inches). A second sheave or sheave group 5B may be disposed substantially near the middle or center of the vertical member 1, e.g. attached or fixed in a middle region of the vertical member(s) 1. The second (e.g. middle) sheave may be slightly below or above the middle, e.g. substantially (e.g. +−10%) 40% of the way from the bottom to the top of the vertical member 1. Positioning a sheave 40% of the distance from the bottom to the top may, with a certain length of line, may prevent a carabiner at the end of a line from bumping against a middle sheave group. A third sheave or sheave group 5A may be disposed substantially at the second end near the ceiling of the vertical member 1, e.g. approximately (e.g. +−10%) 5% of the way from the top/ceiling end of vertical member 1 or approximately 5 inch(es) from the ceiling. In some embodiments, ceiling heights may exceed a standard 8' height, in this case, the third sheave may be in the same relationship with second and first sheave (e.g. or sheave groups), with the third sheave being substantially disposed away from the ceiling. For example, a 10' ceiling may have the third sheave disposed approximately 2' away from the ceiling. A permanent foot support and accessory mount 11 may be inserted through the vertical member 1 to allow the user to stabilize their body during various exercises. A different number of sheaves or pulleys, or groups, may be used; e.g. four groups or two groups of sheaves or pulleys may be used. Instead of groups, individual sheaves may be used. Dimensions shown in the drawings are example dimensions; other dimensions may be used.

When in use, the weight may be attached to a line extending from a rear side, and a user handle or attachment may be attached to the line extending from a front side: e.g. the flexible line may be fixed to a weight at a first end, threaded through at least two sheaves or pulleys, and connected to a handle at a second end, such that the weight hangs from a pulley on one side of the device, and the handle is connected to the line exiting a pulley on another side of the device.

Figure 2:
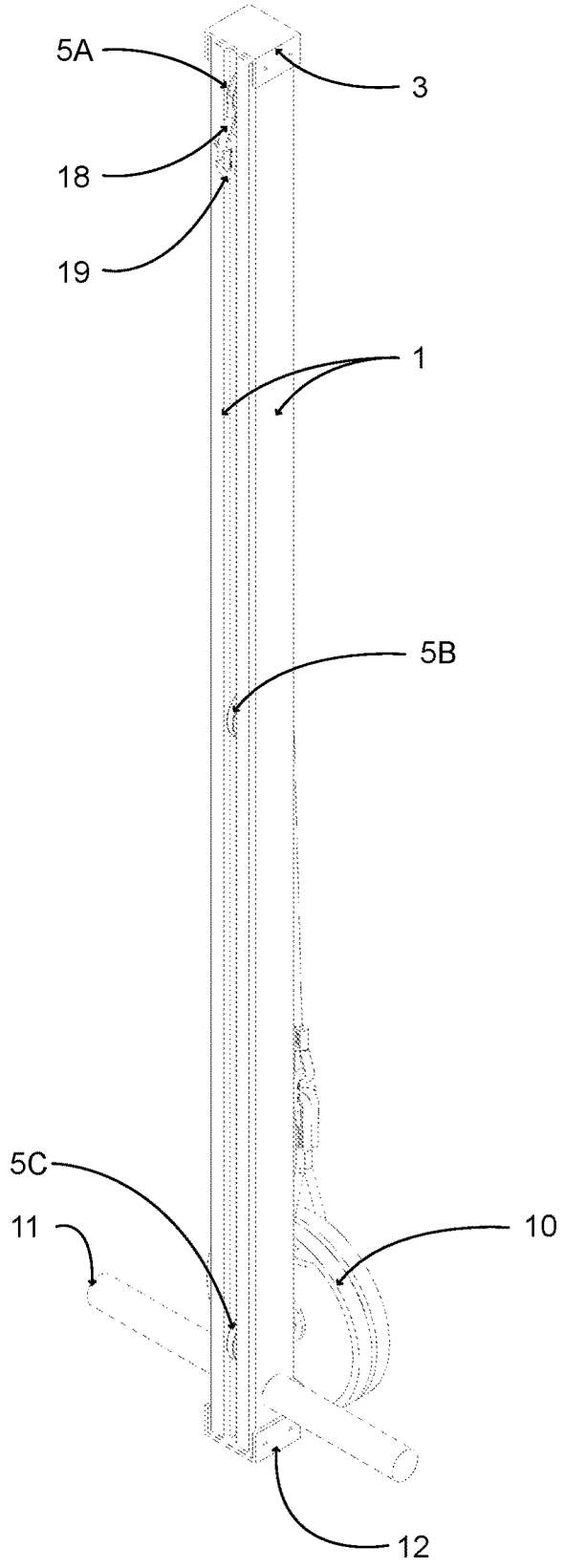
FIG. 2 is an axonometric front view of an exercise system assembly according to embodiments of the present invention.
Figure 3:
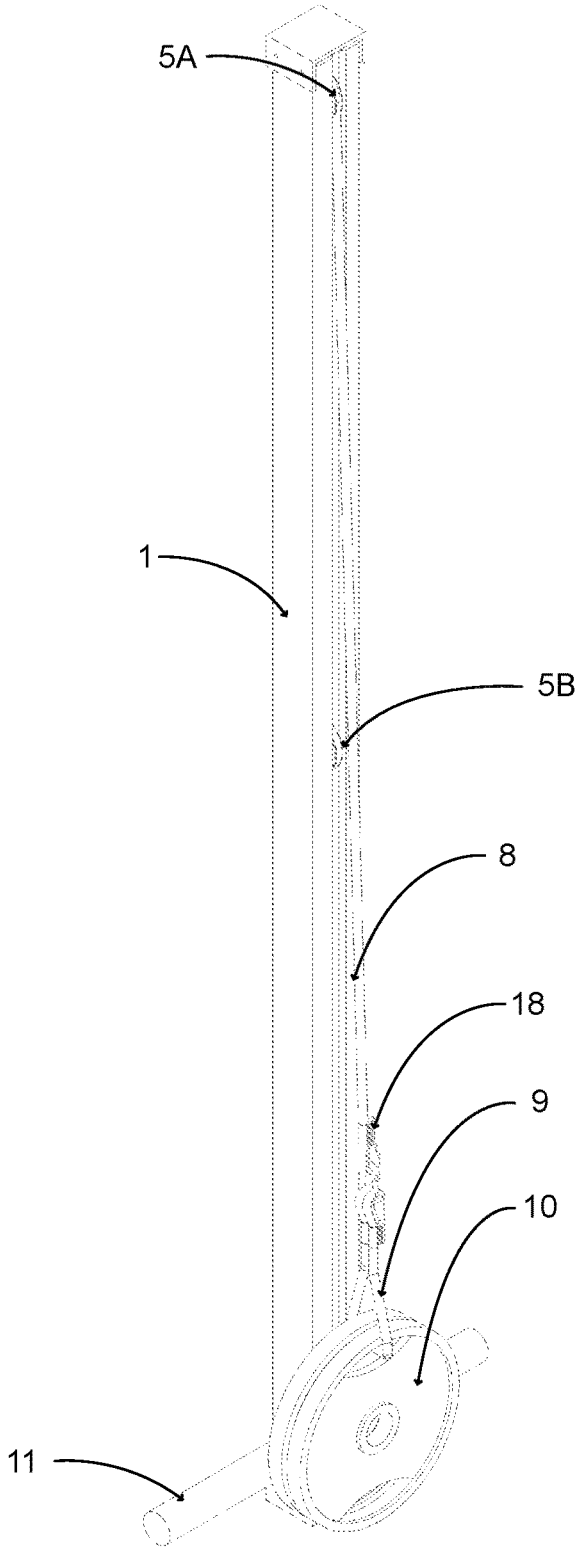
FIG. 3 is an axonometric rear view of an exercise system assembly according to embodiments of the present invention.

FIG. 2 is an axonometric front view of an example embodiment of an exercise device assembly, showing the vertical member 1, floor bracket assembly 12, ceiling mounting bracket assembly 3, as well as the foot support 11, and sheaves 5A-5C according to embodiments of the present invention. Also shown is a sewn eye splice 18 at the terminus of the rope. In one embodiment, a rope attached at one end to a weight, threaded through an upper sheave, may have its non-weight end hang approximately 8 inches from the top of the device, ready to be attached to a further rope. The non-weight end may include a rope clamp or stop block to keep the weight plates suspended when the system is not in use or between exercises. Alternate methods of creating a termination may be used such as a woven eye splice, a mechanical clamp, or knot may also be used. These terminations may or may not be permanent, and a connector, e.g. a carabiner, may be permanently mounted to a terminus of a line or rope. A load rated coupling device such as a carabiner 19 may be connected to the sewn eye splice 18. One or more carabiners 19 may allow the user to connect lines together end-to-end to create larger lines of different lengths, interchange accessories or attachments or connect to other flexible lines or ropes 8 (Shown in FIG. 3). Flexible lines 8 may be made from, for example by, static climbing rope made of a nylon core, a non-expanding rope with a decorative outer sleave. Flexible lines 8 may be any type of flexible line such as nylon, poly, fiber, cotton, manila, etc. Other flexible lines could be used, even braided or stranded steel wire. Carabiner 19, or other connectors, may be used to connect and interchange different sized ropes of the exercise system. Carabiner 19, or other connectors, may prevent the ends of lines from running or being pulled past sheaves. Carabiner 19 may serve as a guide for the pulley system, for example, carabiner 19 may be designed to fit between the gap or slot of the sub-members 1' and act as a guide for counterweight 10 (an example of which is shown in FIG. 3) to stay within its vertical path during use e.g. to prevent side to side motion of counterweight 10. In some embodiments, the carabiner 19 may be attached to a track, providing stability to counterweight 10 and stabilizing its vertical motion.

FIG. 3 is an axonometric rear view of an example exercise system assembly according to embodiments of the present invention, showing the routing or running of flexible line 8 over the sheave 5A and down to lanyard 9 which is looped through the counterweight 10, which in one embodiment hangs from the rear of the device, but which may be positioned elsewhere. Sheaves 5A-5C may have a U shaped or other shaped channel allowing cables, or similar flexible line to be fed between the sub-members 1' and looped around the U-shaped channels of sheaves 5A-5C in various configurations. A rope loop or lanyard 9 may be attached to the sewn eye splice 18, to counterweights 10 such as metal plates, kettle bells, or similar free weights. The lanyard 9, similar to carabiner 19, may be designed to travel between the sub-members 1' and may guide counterweight 10. In some embodiments, the lanyard 9 may be attached to a track, providing stability to counterweight 10 and stabilizing its vertical motion.

Figure 4A:
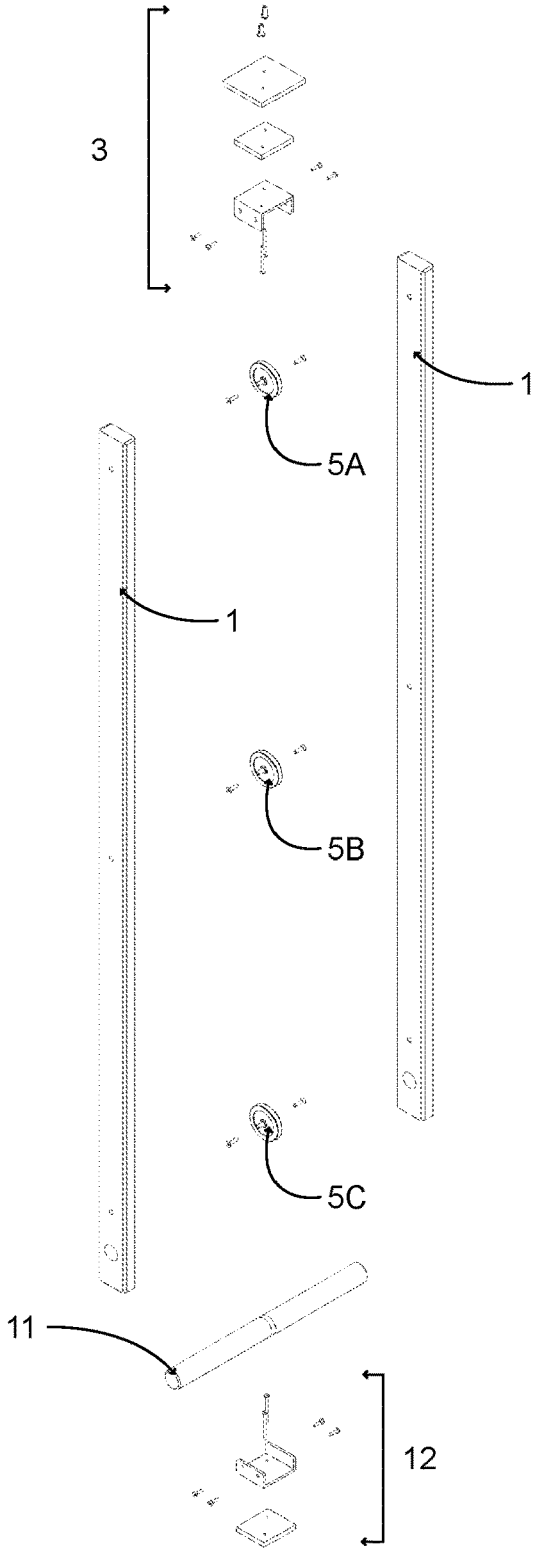
FIG. 4A is an exploded axonometric diagram of exercise machine components according to embodiments of the present invention.

FIG. 4A is an exploded axonometric diagram of an example exercise assembly components according to embodiments of the present invention. The three rotating U channel sheaves 5A-5B may be positioned between the two sub-members 1' which are then bound by connecting bolts 6 and the ceiling mounting bracket assembly 3 and floor mounting bracket assembly 12. The foot support 11 may also be positioned between the vertical members, set equidistant from the front face and back face of the sub-members 1'.

Figure 4B:
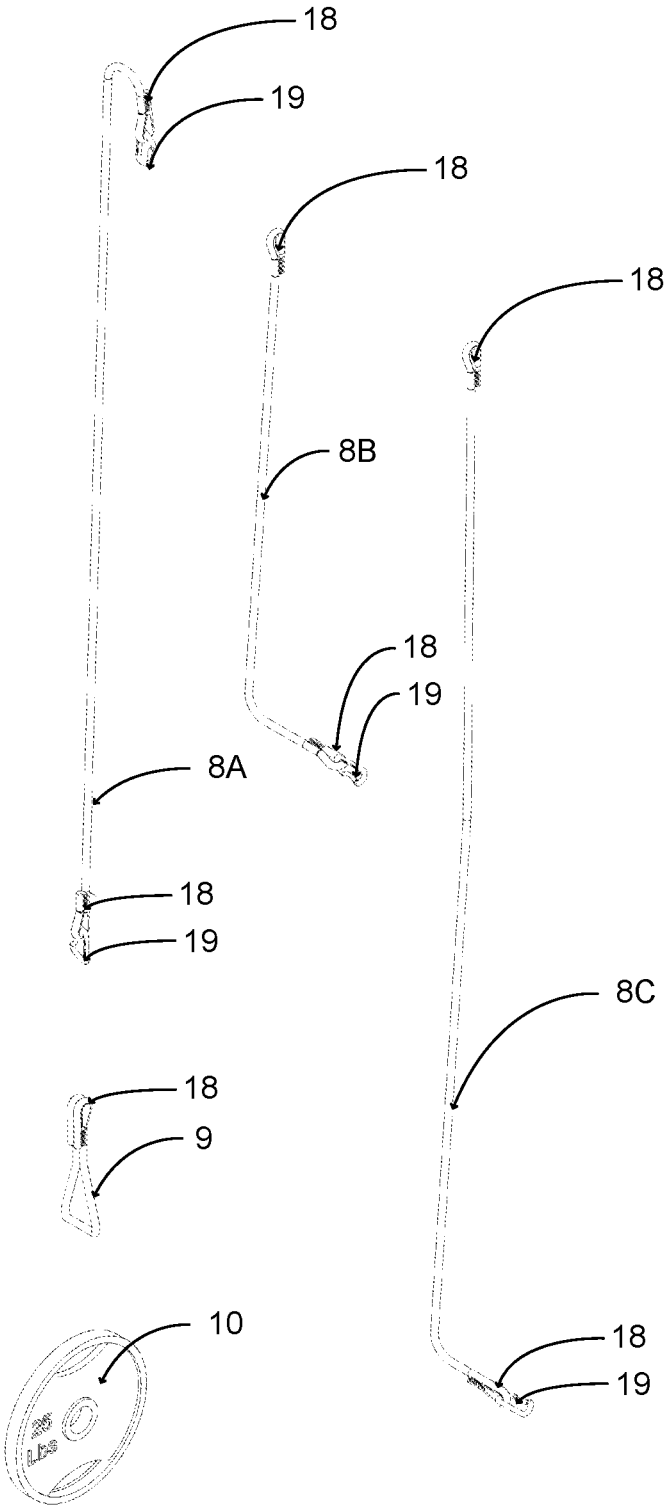
FIG. 4B is an exploded axonometric diagram of a set of flexible lines of various lengths according to embodiments of the present invention.

FIG. 4B is an exploded axonometric diagram of an example set of flexible lines according to embodiments of the present invention. A series of flexible lines of various lengths may be included in the exercise device, each typically terminated with a sewn eye splice 18 allowing connections to be made (e.g. end-to-end) between the various flexible lines 8A-8C using the carabiner 19. A set of flexible lines, each of a different length, or at least some having different lengths, e.g. three different lines, or another number, may be included or provided with the exercise device to a user, and a user may use one line for an exercise, or may combine more than one line to produce a longer line, for an exercise. For example, a possible set of flexible line lengths may be such that flexible line 8A may measure approximately (e.g. +−10%) 6' 3.5" from eye to eye, flexible line 8B may measure approximately (e.g. +−10%) 2' from eye to eye, and flexible line 8C may measure approximately (e.g. +−10%) 6' 9.5" from eye to eye. The example set of lengths are measured such that the travel of carabiners do not make contact with the sheaves. In such a manner, the multiple flexible lines may be combined in different combinations to form a flexible line of varying (e.g. user defined) lengths in order to properly travel the various configurations created when a flexible line is threaded through different combinations of sheaves to allow for different positioning of the line relative to the user, and different exercises. The user may connect a flexible line to a weight at one end of the line, and thread the line through at least two of the first sheave, second sheave or third sheave. Typically, the line is threaded through and runs through at least two sheaves or sheave groups, but may be threaded through other numbers of sheaves. Flexible line 8A may be the primary flexible line which on one end connects to the counterweight 10 with lanyard 9 and on the other end connects to either an accessory handle or a secondary flexible line (or more than one additional line) such as 8B or 8C with carabiner 19. Flexible lines 8A-8C may have custom lengths to ensure carabiner 19 will not bump against any of the sheaves 5A-5C during use. For example, turning to FIG. 11, assume a user performs an exercise which results in pulling the flexible line 8B through sheave 5B in a direction 7 a maximum length of 20". To avoid the carabiner 19 which connects flexible line 8A to flexible line 8B from making contact with sheave 5B, the flexible line may be a minimum length of 20" to avoid the carabiner 19 making contact with sheave 5B. While the various sheaves are typically fixed to vertical member 1, in some embodiments the sheaves may be moveable. For example, the sheave 5B may also be lowered in order to avoid contact with carabiner 19 without having to change the length of the flexible line 8B. Flexible line 8C may also have a custom length to avoid the carabiners 19 making contact with the sheaves 5A-5C.

Figure 10:
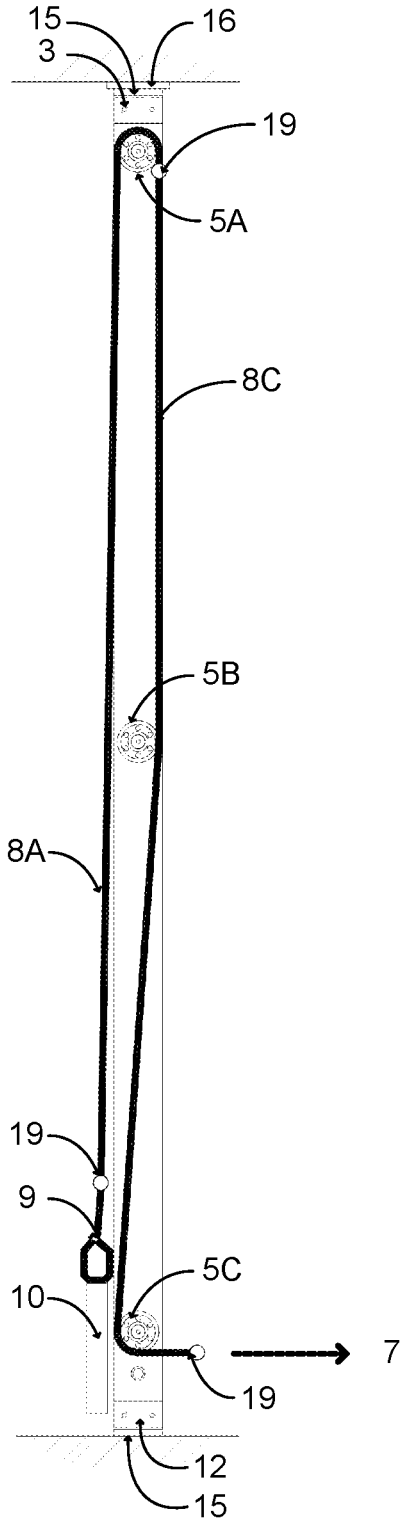
FIG. 10 is a section diagram of a rope path for floor level exercises according to embodiments of the present invention.
Figure 11:
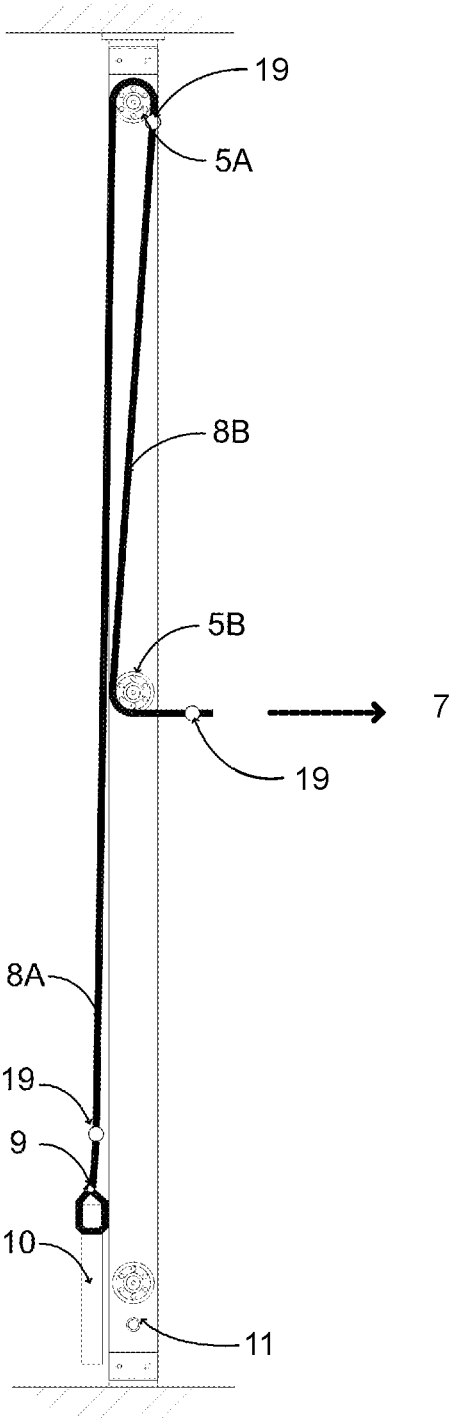
FIG. 11 is a section diagram of a rope path for waist level exercises according to embodiments of the present invention.

The counterweight 10 is connected to the primary flexible line 8A by for example of a lanyard 9 or in some embodiments a load bearing carabiner 19. The primary flexible line 8A typically remains in place on the exercise device, looped over the sheave 5A. Exercises may be performed by connecting accessory handles to the terminus of flexible line 8A using for example a carabiner 19 connected to the terminus sewn eye splice 18. Additional lines may be attached to the terminus of line 8A to created longer lines, e.g. so that the lines may be run through more sheaves than one sheave. For ceiling level exercises, refer to FIG. 12 for an example routing path of the flexible line 8A. To perform exercises with the accessory handles at a waist level height, a secondary flexible line 8B may be connected to flexible line 8A by for example of a carabiner 19 through the sewn eye splice 18 of each flexible line. Refer to FIG. 11 for an example routing path of the flexible line 8B attached to flexible line 8A. To perform exercises with the accessory handles at a floor level height, a secondary longer flexible line 8C may be connected to the sewn eye splice 18 of flexible line 8A by for example of a carabiner 19. Refer to FIG. 10 for an example floor level routing path of the flexible line 8C attached to flexible line 8A. Although flexible lines, for example fibrous ropes attached to load bearing carabiners are used in this embodiment, alternate flexible line materials such as cable rope and "S" hooks connectors may also be used.

Figure 4C:
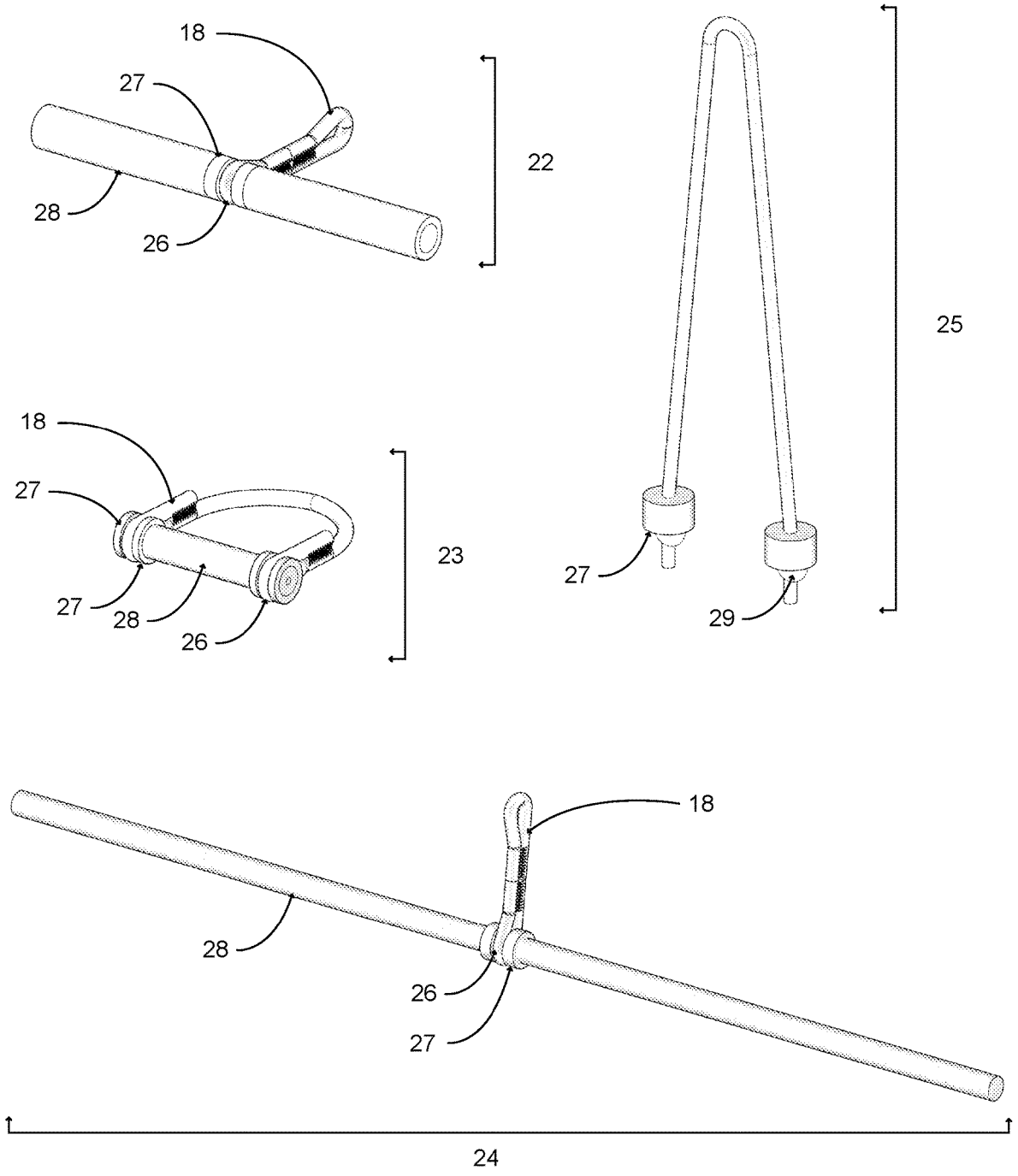
FIG. 4C is a diagram of various accessory handles according to embodiments of the present invention.

FIG. 4C is a diagram of an example set of various accessory handles according to embodiments of the present invention. The accessory handles may be connected to an example system at varying set up heights. Shown in these set up diagrams is a short bar 22, a handle 23, a long bar 24, and a double rope 25. These handles as well as other variations of handles may be connected to the flexible lines 8A-8C by a connector such as carabiner 19 at any of the various heights once they are properly configured. The use of a bench, exercise ball, floor riser or other accessory may be used to achieve the maximum number of exercises by allowing the user to stabilize their body in various positions at various heights. A short bar 22 may utilize for example 2" wood dowel 28 and wood stop rings 27 in conjunction with a rope lanyard 26 with sewn spliced eyes 18 at each end. The interior diameter of the sewn spliced eye at the dowel side may match the outside diameter of the dowel. The wood stop rings may have an internal diameter which may match the outside diameter of the wood dowel, allowing the larger external diameter to secure the lanyard in place. The handle 23 utilizes a wood dowel 28 and wood stop rings 27 to secure a rope lanyard 26 with sewn spliced eyes 18 at each end. The interior diameter of the sewn spliced eye may match the diameter of the wood dowel. The outside wood stop rings 27 may be secured into the ends of the dowel by for example of a mechanical fastener and washer. The handle may be connected to the exercise device flexible line 8 by for example of a carabiner or similar mechanical connector at the center point of the lanyard 26. The long bar 24 utilizes a for example 1.5" wood dowel 28 and wood stop rings 27 in conjunction with a rope lanyard 26 with sewn spliced eyes 18 at the end. The interior diameter of the sewn spliced eye at the dowel side matches the outside diameter of the dowel. The wood stop rings' internal diameter may also match the outside diameter of the wood dowel, allowing the larger external diameter to secure the lanyard in place. The double rope 25 utilizes a for example 24" long rope with knots at each end 29. The rope may be routed through wood rings 27 with an internal bore matching the rope diameter and an external diameter of for example 1.5" and may be secured in place by for example of the knots. It may be connected to flexible line 8 by for example of a carabiner or similar mechanical connector at the center point of the accessory rope 25. The dowels and rings are primarily solid wood, however other materials may be used. These accessory handles are primarily made of round wood dowels and static 7/16" rope, however other materials and sizes may be used. As with the example dimensions for the handles, other dimensions may be used.

Figure 5:
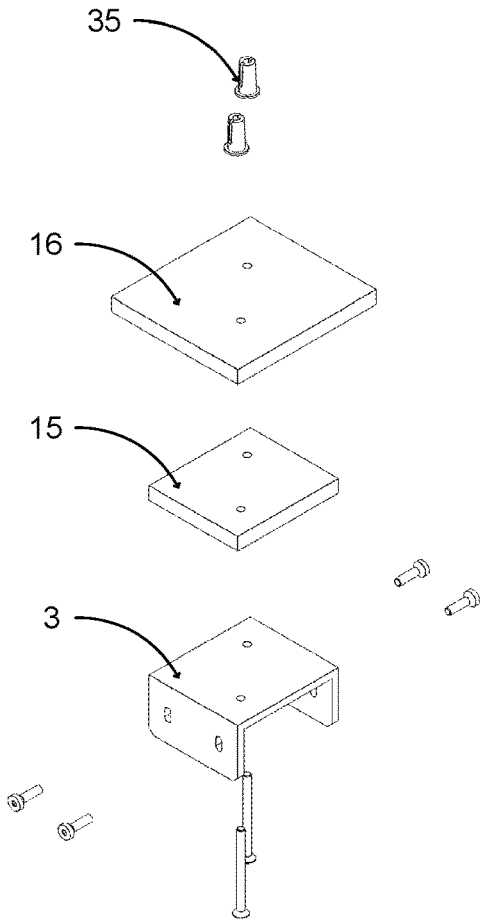
FIG. 5 is an exploded axonometric diagram of a ceiling mount assembly according to embodiments of the present invention.

FIG. 5 is an exploded axonometric diagram of an example embodiment of a ceiling mount assembly according to embodiments of the present invention. The primary component of the assembly is the ceiling bracket 3 which mechanically connects the two sub-members 1' to each other and also mechanically connects to the ceiling by for example of mechanical fasteners. It may be made of metal or another structurally suitable material. Included on the vertical faces of the bracket may be slotted holes which allow for fine vertical adjustment during installation for a secure fit. An isolation pad 15 made of neoprene rubber or another vibration reducing material may limit the transfer of sound and vibration from the exercise device to the surrounding room and beyond. Located between the isolation pad 15 and the ceiling of the room may be a spacer 16 which allows for both the fine vertical adjustment for a secure fit. It may also serve as a way to spread mechanical fasteners, such as wood screws, further apart for a secure connection to typical hollow drywall or similar ceilings.

Figure 6:
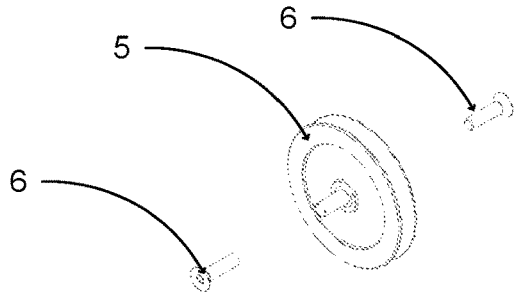
FIG. 6 is an exploded axonometric diagram of a U channel sheave assembly according to embodiments of the present invention.

FIG. 6 is an exploded axonometric diagram of a U channel sheave or pulley assembly 5 (e.g. sheaves 5A-5C of FIG. 1) according to embodiments of the present invention. The sheave or pulley 5 may ideally be a U channel sheave for supporting the load and movement of a flexible line or rope, however other sheave and pulley profiles may be used. A friction bearing or anti friction bearing may be mounted or disposed substantially at the center of the sheave allows for smooth movement with minimal vibration during the use of the exercise system. Mechanical fasteners, for example connecting bolts 6, mount through the vertical member 1 and support the sheave 5 at the inside face of the bearing. These fasteners may be for example button head bolts for a low profile appearance, or may be countersunk for a flush appearance or recessed to allow for wood plugs and a nearly concealed seamless appearance.

Figure 7:
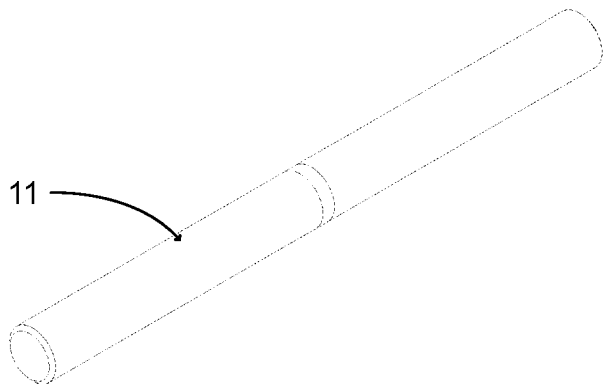
FIG. 7 is a diagram of a foot support according to embodiments of the present invention.

FIG. 7 is a diagram of an example foot support according to embodiments of the current invention. Foot support 11 may be centered in depth between the front face and back face of the vertical member 1 and impaled at the sides of the vertical member 1 at an elevation. Any elevation may be used; however, it may be preferred to be impaled on the vertical member 1 near or at the bottom of the vertical members. Elevation of lines exiting the device, or of user handles or controls such as foot support 11, may be controlled by the user running lines through certain sheaves, which are fixed at certain heights. In a preferred embodiment it is made of solid wood cylinder for a combination of strength and warmth, however, other materials may be used.

Figure 8:
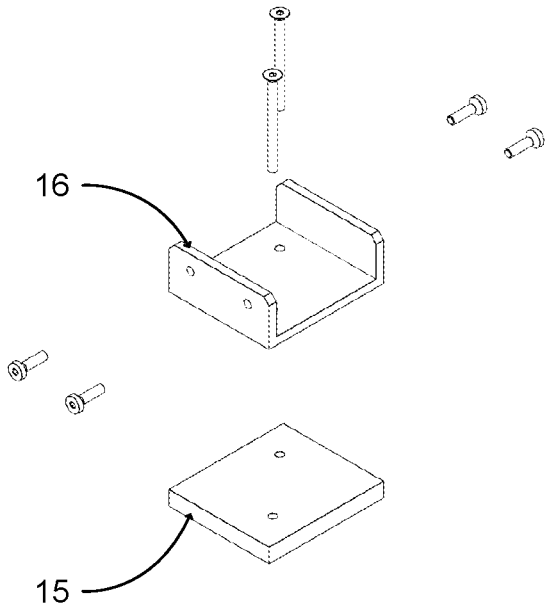
FIG. 8 is an exploded axonometric diagram of a floor mount assembly according to embodiments of the present invention.

FIG. 8 is an exploded axonometric diagram of an example floor mount assembly 12 according to embodiments of the present invention. The assembly may include bracket 16 which mechanically connects the vertical members 1 to each other and also mechanically connects to the floor by for example mechanical fasteners. It may be made of metal or another structurally suitable material. An isolation pad 15 made of neoprene rubber or another vibration reducing material may limit the transfer of sound and vibration from the exercise device to the surrounding room and beyond.

Figure 9:
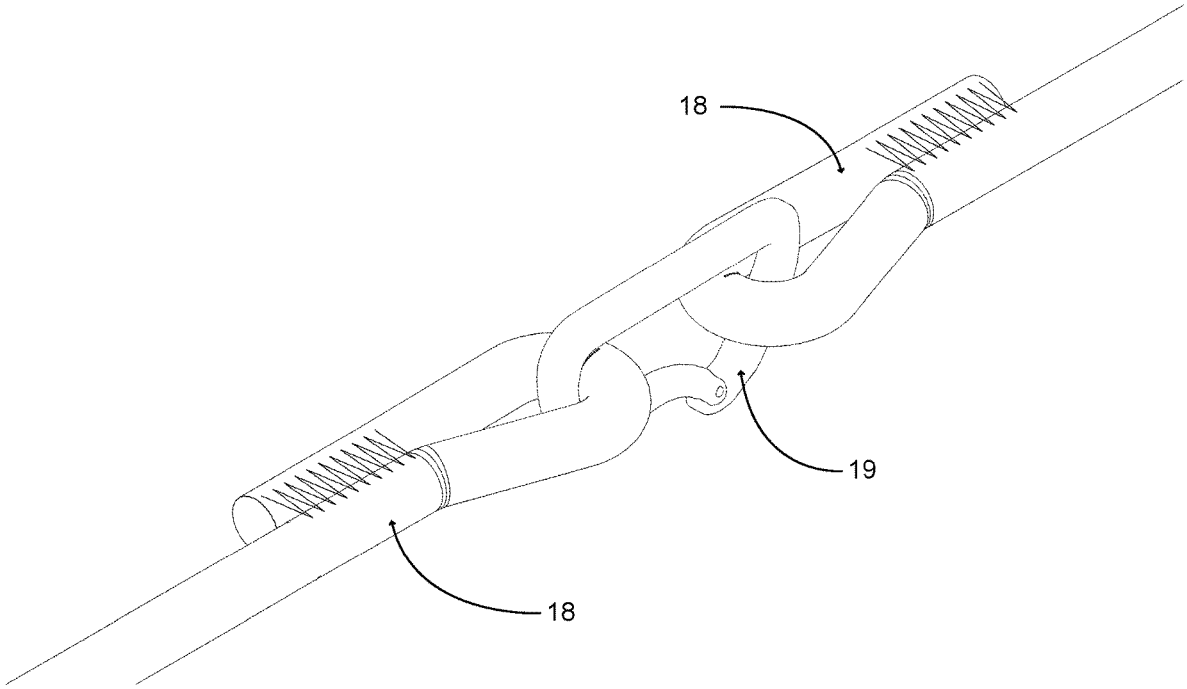
FIG. 9 is a diagram of a rope termination according to embodiments of the present invention.

FIG. 9 is a diagram of an example flexible line or rope termination showing a sewn spliced eye 18 according to embodiments of the present invention. A method of terminating a line to allow for connection to other lines or equipment other than spliced eyes may be used. This may allow for a mechanical link such as a carabiner 19 to be fed through the eye or an accessory handle component to be inserted through the eye. The diameter of the eye may be ½" for carabiner connections and may be larger for some accessory handles to match the diameter of the element being inserted. Rope color and splicing thread colors can vary for customization. Decorative accents such as colored shrink wrap tube may also be used for further customization and color accent. Although fibrous rope and load bearing carabiners are used in this embodiment, alternate materials such as cable rope and "S" hooks connectors may also be used.

FIG. 10 is a section diagram of an example rope path for floor level exercises according to embodiments of the present invention. FIG. 10 shows primary flexible line 8A, running from the counterweight 10 at one end (e.g. running from the line's connection to the counterweight) of the vertical member 1 which is connected to lanyard 9 connected by a connector such as carabiner 19 (e.g. carabiner 19 connecting the sewn eye splice 18 to the lanyard 9) and threaded up to and around an upper sheave 5A at another end of the vertical member 1, running along the U channel of the sheave 5A. Connection devices other than carabiners may be used. Thus a line may run from a counterweight to a sheave. Connected to flexible line 8A via another carabiner 19 or similar mechanical connector is flexible line 8C, which is routed down to the sheave 5B and then diagonally down to and threaded around the rear of the lower sheave 5C, such that the user handle is connected to a line exiting the bottom of the device. It may then be pulled towards the user (not shown, existing in the direction 7) and connected to an accessory handle by for example of another carabiner 19 or similar mechanical connector. In such a manner the combined flexible line connects to a weight at one end, is threaded through at least two of the first sheave, second sheave or third sheave—in this case over the upper sheave and around the bottom sheave, and touching or guided by a middle sheave. The user may perform floor level exercises and then alter the configuration to then perform waist level or ceiling level exercises by removing flexible line 8C completely from the exercise system by disconnecting from the carabiner 19 which connects flexible line 8A to flexible line 8C and then unthreading flexible line 8C from the sheaves 5B and 5C. To perform waist level exercises, flexible line 8A is connected to flexible line 8B as shown in FIG. 11. To perform ceiling level exercises, flexible line 8A is connected directly to an accessory by carabiner 19 as shown in FIG. 12.

FIG. 11 is a section diagram of an example rope path for waist level exercises according to embodiments of the current invention. It shows the primary flexible line 8A, running from the counterweight 10 at one end of the vertical member 1 connected to lanyard 9, up to and over the sheave 5A at another end of the vertical member 1. Connected to flexible line 8A via a carabiner 19 or similar mechanical connector is flexible line 8B, which is routed diagonally down to and threaded around the rear of sheave 5B. It may then be pulled toward the user 7 and connected to an accessory handle by for example of a carabiner 19 or similar mechanical connector.

Figure 12:
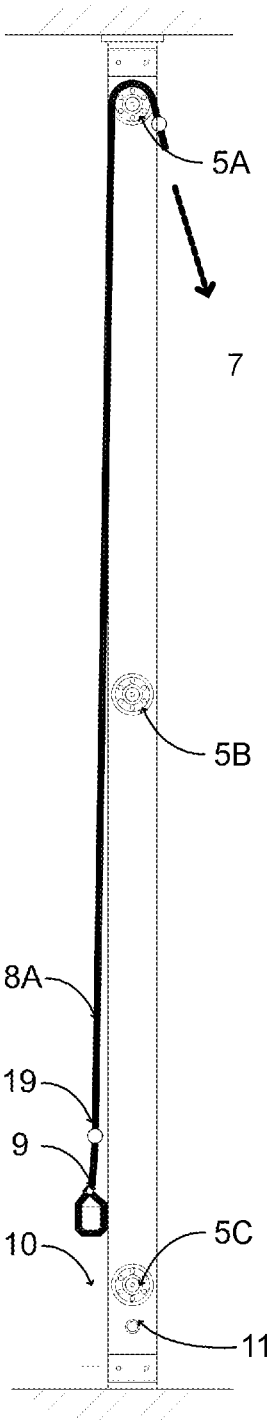
FIG. 12 is a section diagram of a rope path for ceiling level exercises according to embodiments of the present invention.

FIG. 12 is an example section diagram of an example rope path for ceiling level exercises according to embodiments of the current invention. It shows the primary flexible line 8A, running from the counterweight 10 at one end of the vertical member 1 connected to lanyard 9, up to and through the sheave 5A at another end of the vertical member 1. It may then be pulled toward the user (direction 7) and connected to an accessory handle by for example of a carabiner 19 or similar mechanical connector. When changing the flexible line configuration, the unused flexible lines may be disconnected from the carabiner and easily removed from the exercise device and set aside. The user may use the device to perform cable-based exercises by for example connecting a counterweight to a flexible line, selecting a length of line for the cable-based exercise (e.g. by selecting one of a different set of different length lines, and/or connecting the lines together), and running the line through at least two pulleys of a pulley device including at least three pulleys. The user pulls on a handle connected to the line to perform the exercise.

Figure 13:
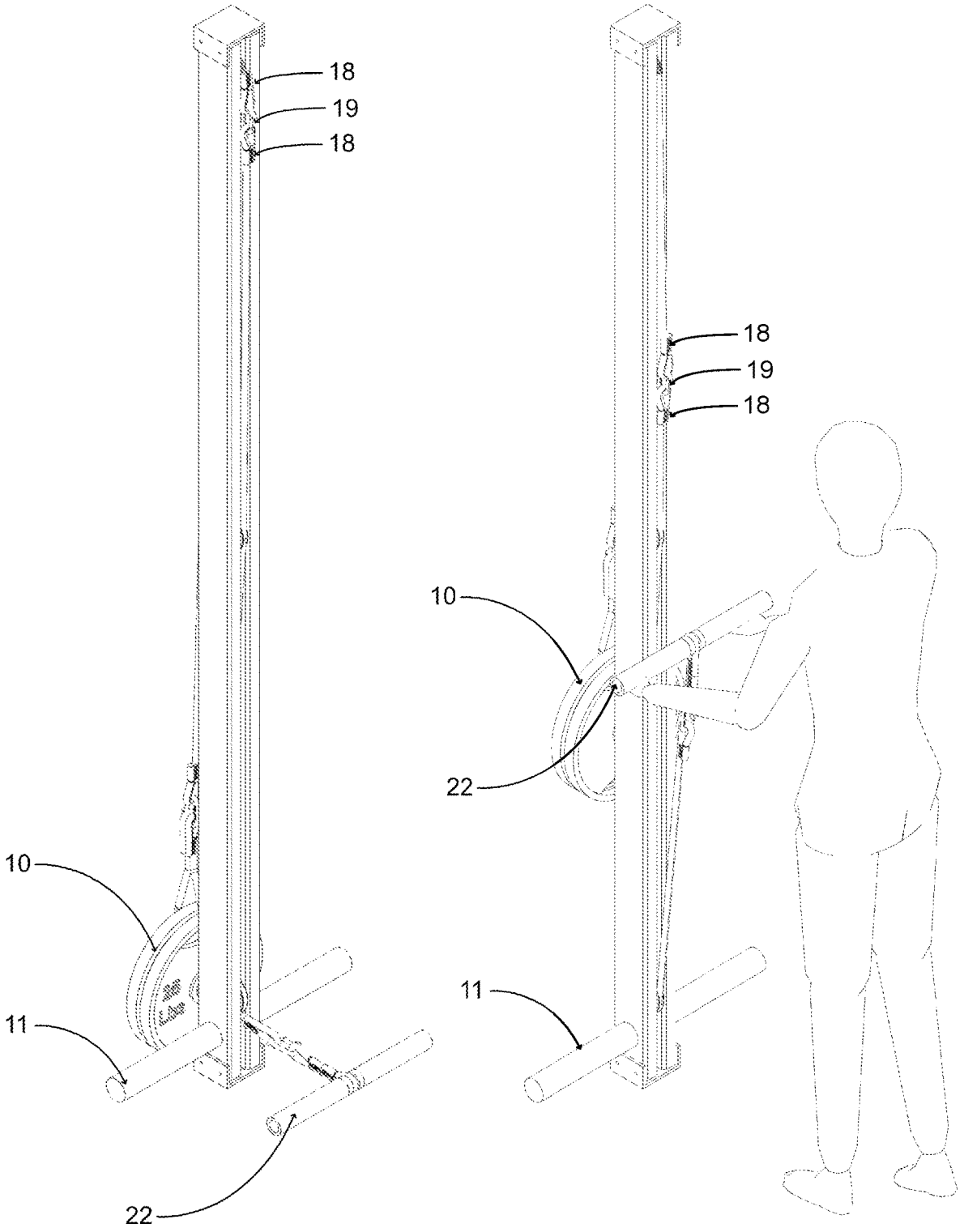
FIG. 13 is a diagram of an exercise system configuration performing a bicep curl with a short bar handle attachment according to embodiments of the present invention.

FIG. 13 shows a user performing a bicep curl exercise with the short bar accessory handle 22 according to embodiments of the present invention. In FIG. 13, on the left an example system is shown configured for the user to use, as shown on the right with the user using the system. In FIG. 13, the user has connected two sub-lines using a carabiner to form a longer line of appropriate length, which the user then threads through the lower pulleys, the sub-line threaded through the upper pulley is typically affixed in place, ready to be attached to subsequent sub-lines with a carabiner. The weight is attached at the rear of the device (e.g. hanging from the upper pulley with the weight-end of the line exiting from the rear part of the upper pulley) and the handle is attached at the front of the device (e.g. extending from the line exiting the front side of the lower pulley). Appropriate length for an exercise may be a length that both allows the combined line to run through the selected set of pulleys (in this case two, the upper and lower) and also is not too long so that the user must be positioned far from the device. The user may pull the handle attached to the line in order to perform exercise. One method of routing re-sized rope is to first connect the end of rope 8C to the end of, e.g. rope 8A (or another rope) with a connector such as a carabiner, then route the rope portion without the carabiner through the sheaves. Then the carabiner and accessory handle can be attached.

Figure 14:
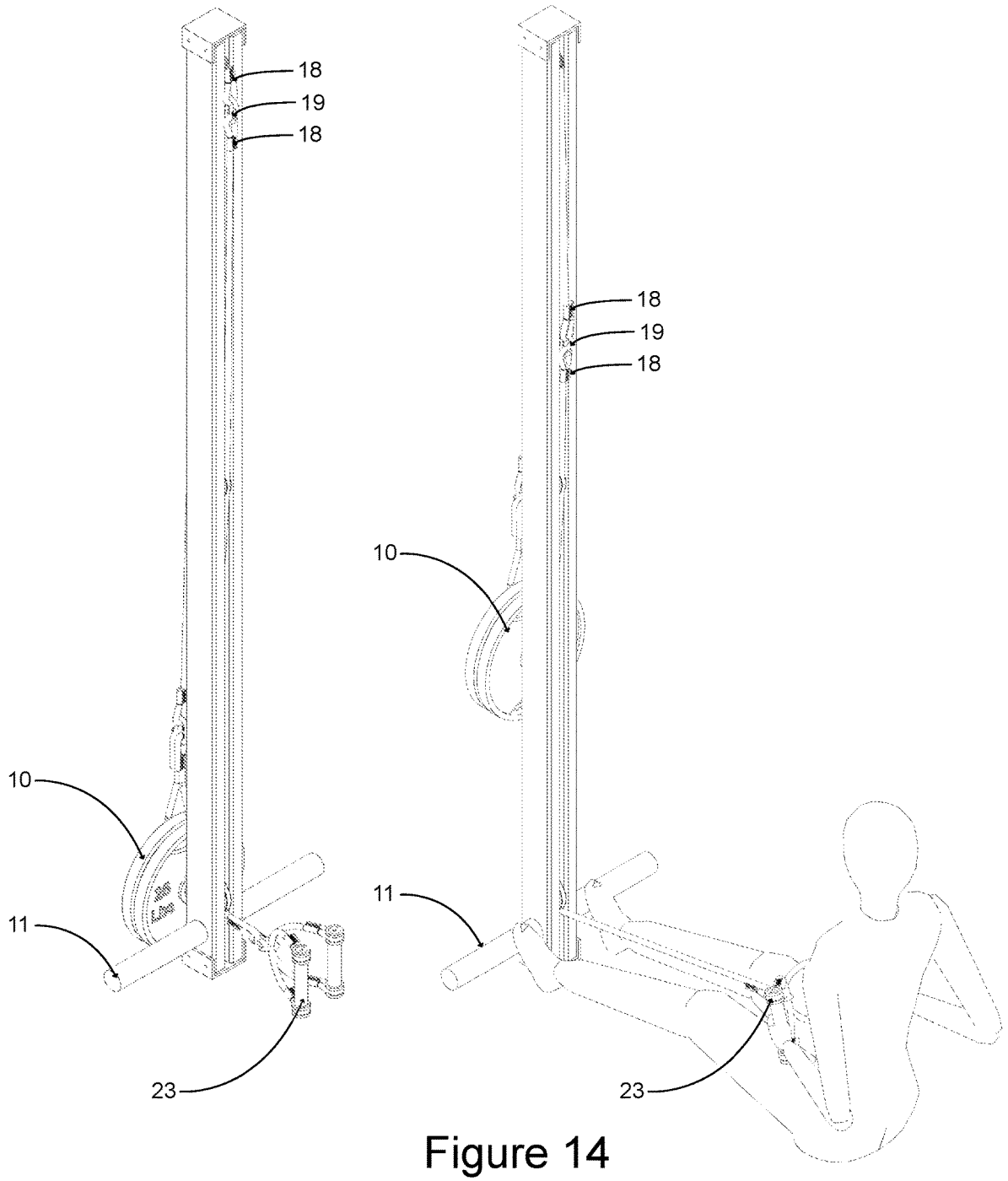
FIG. 14 is a diagram of an exercise system configuration performing a seated row exercise with a handle attachment according to embodiments of the present invention.

FIG. 14 shows a user performing a seated row exercise with a pair of accessory handles 23 according to embodiments of the present invention. In FIG. 14, on the left an example system is shown configured for the user to use, as shown on the right with the user using the system. The exercise system in this example is configured for a floor level connection between the handle and the counterweight 10 as shown in FIG. 10 by for example, of rope 8A and 8C. Many standard cable based exercises may be performed by connecting various accessory handles to the floor level configuration. These may include but are not limited to the: Bicep curl, Cable Row Squat, Upright Row, One Arm Triceps Extension, Side Raise, Standing Cable Lift, Low Crunch, Bent Over Side Lateral, Seated Row, Unilateral Row, Bilateral Row, Shotgun Row, Pull Through, Reverse Lunge, Hip Abduction, Hamstring Curls, One Leg Hyper Extension, Front Leg Extension, Calf Raise, Donkey Kicks, Suit Case Split Squat and Goblet Squat.

Figure 15:
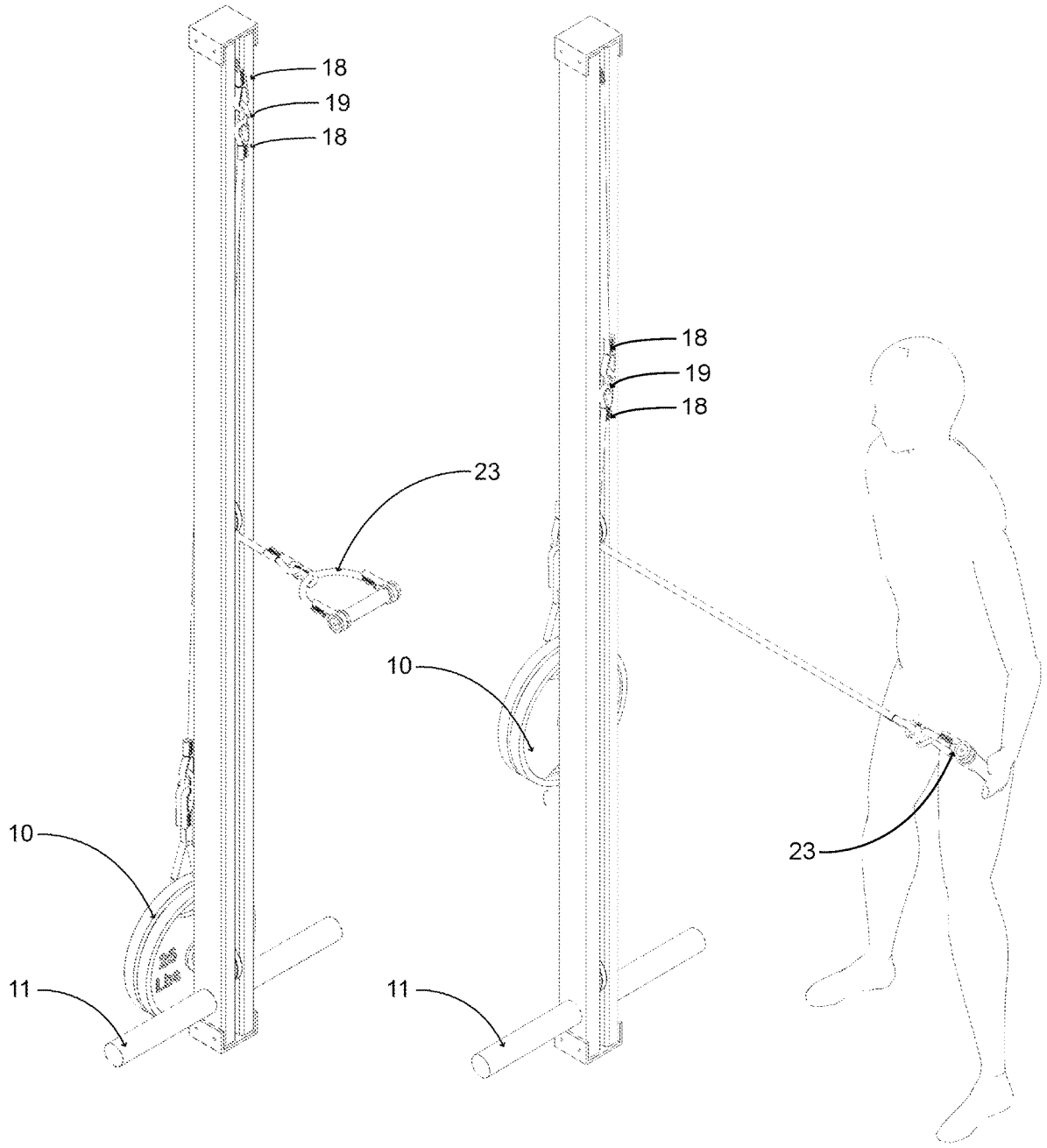
FIG. 15 is a diagram of an exercise system configuration performing a single arm reverse fly exercise with a handle attachment according to embodiments of the present invention.

FIG. 15 shows a user performing an external side rotation exercise with the accessory handle 23 according to embodiments of the present invention. In FIG. 15, on the left an example system is shown configured for the user to use, as shown on the right with the user using the system. The exercise system in this example is configured for a waist level connection between this handle and the counterweight 10 as shown in FIG. 11 by for example of flexible lines 8A and 8B. Many standard cable-based exercises may be performed by connecting various accessory handles to the waist level configuration. These may include but are not limited to: External Rotation, Internal Rotation, Triceps Kickback, Torso Twist, Rear Delt Row, Face Pull, Bent Over Lat Pull and Unilateral Overhead Press.

Figure 16:
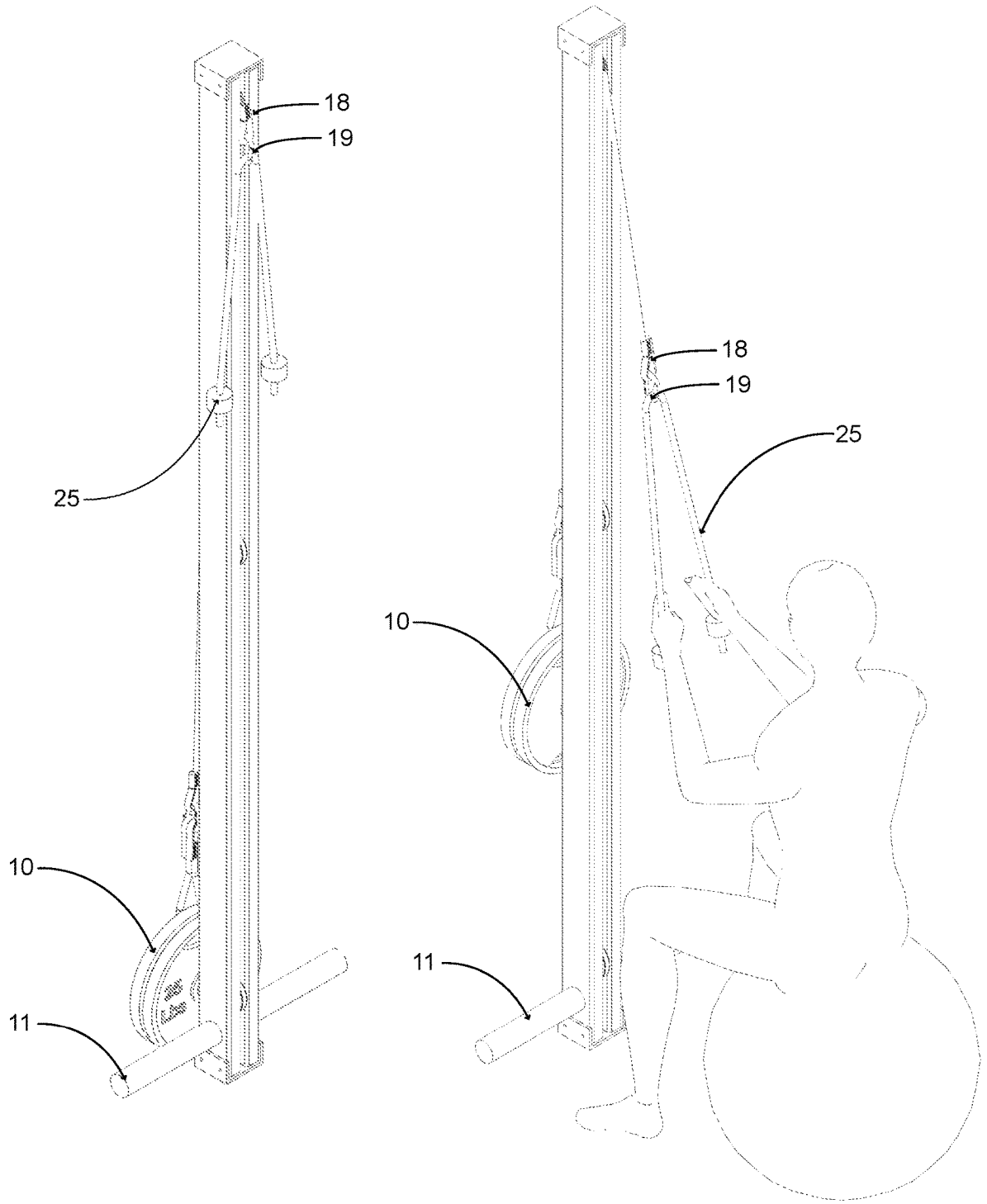
FIG. 16 is a diagram of an exercise system configuration performing a seated tricep pushdown exercise with a double rope attachment according to embodiments of the present invention.
Figure 17:
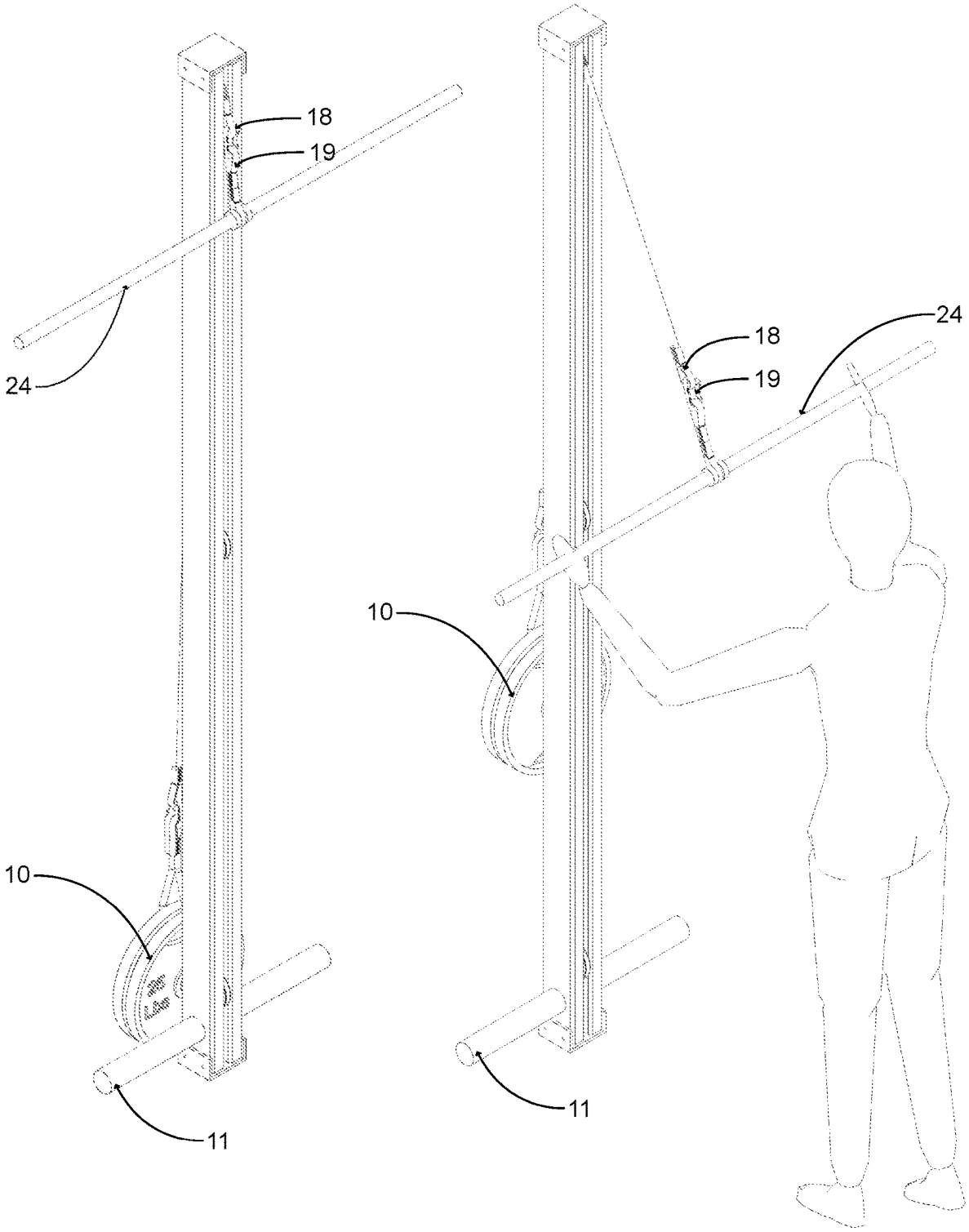
FIG. 17 is a diagram of an exercise system configuration performing a standing lateral pulldown exercise with a long bar attachment according to embodiments of the present invention.

FIG. 16 shows a user performing a seated triceps extension exercise with the accessory double rope 25 while seated on an exercise ball according to embodiments of the present invention. In FIG. 16, on the left an example system is shown configured for the user to use, as shown on the right with the user using the system. FIG. 17 shows a user performing a standing lateral pulldown exercise with the long bar 24 according to embodiments of the present invention. In FIG. 17, on the left an example system is shown configured for the user to use, as shown on the right with the user using the system. In this view an example exercise system is configured for a ceiling level connection between this handle and the counterweight 10 as shown in FIG. 12 by for example of flexible line 8A. Many standard cable based exercises may be performed by connecting various accessory handles to the ceiling level configuration. These may include but are not limited to the: Overhead Triceps Extension, Standing Triceps Extension, Seated Triceps Extension, Woodchop, High Crunch, Lat Pushdown, Wide Grip Pull Down and Hip Hinge. In FIGS. 16 and 17, a single or combined line (e.g. made from one or more sub-lines, e.g. flexible line 8A) has been threaded through the upper sheave, with a weight-attached at the end of the line hanging down from the upper sheave at the rear face of the vertical member. The single line threaded from the upper sheave may then be attached by carabiner to the end of the single line.

Figure 18:
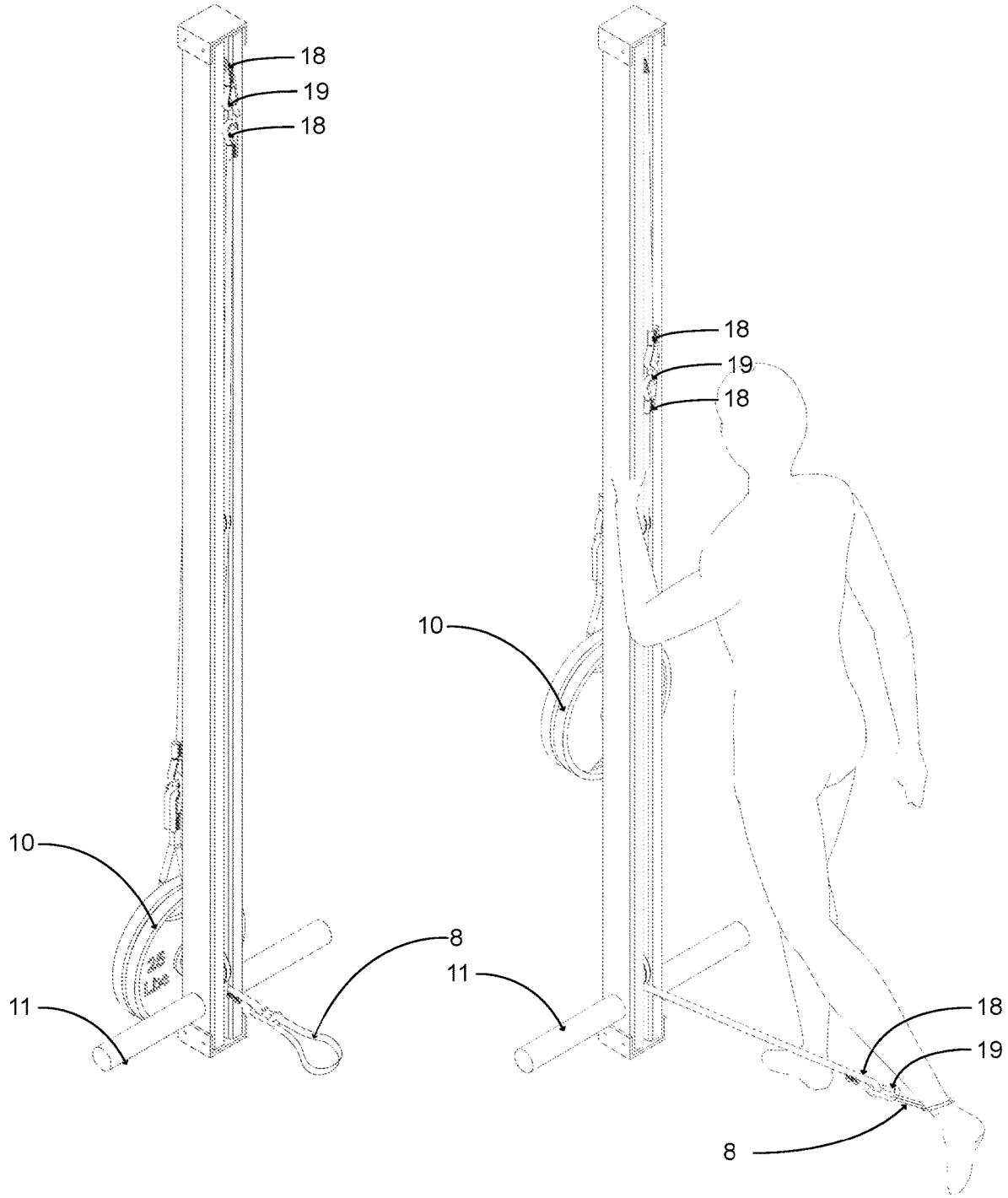
FIG. 18 is a diagram of an exercise system configuration performing a leg extension exercise according to embodiments of the present invention.

FIG. 18 shows a user performing a standing cable leg extension exercise with a lanyard 9 according to embodiments of the present invention. In FIG. 18, on the left an example system is shown configured for the user to use, as shown on the right with the user using the system. The exercise device is configured for a floor level exercise by for example of a lanyard directly connecting to counterweight 10, as shown in FIG. 10, by for example to flexible lines 8A and 8C, with the terminating end connected to the user's leg. Many standard cable based exercises may be performed by connecting various accessory handles to the floor level configuration. These may include but are not limited to the: bicep curls, row, or standing cross-fly.

Figure 19:
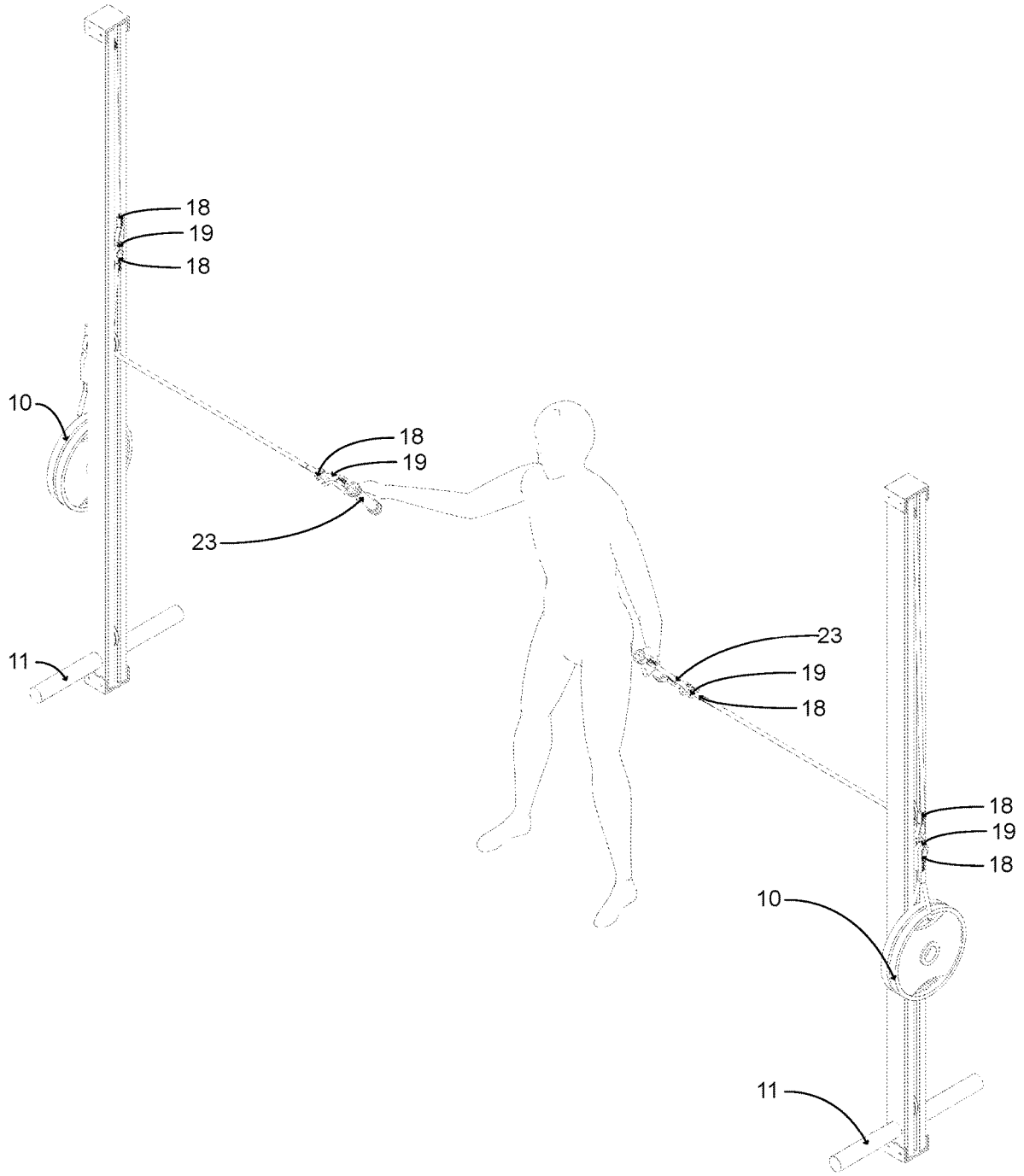
FIG. 19 is a diagram of a dual exercise system configuration performing a cable cross-over exercise with handle attachments according to embodiments of the present invention.

FIG. 19 shows a user performing a mid cross-over exercise with a pair of accessory handles 23 connected to a pair of exercise devices which are facing each other according to embodiments of the present invention. By configuring a pair of exercise devices in close proximity to each other such as in a facing configuration, additional exercises may be performed by the user. These may include but are not limited to the: Upper Cross Over, Mid Cross Over, Lower Cross Over, Cable Fly, Standing Cable Fly and Bicep Curl. In FIGS. 15 and 19, a combined line (e.g. made from one or more sub-lines, e.g. flexible lines 8A and 8B) has been threaded through the upper sheave, with a weight-attached at the end of the line hanging down from the upper sheave at the rear face of the vertical members. The combined line threaded from the upper sheave is then (e.g. diagonally) threaded between the sub-members and behind the middle sheave and then pulled outward from the front face of the sub-members from the middle sheave. The handles may then be attached by carabiner to the end of the combined line. In such a way a middle-positioned pulley positions the user handle.

Figure 20:
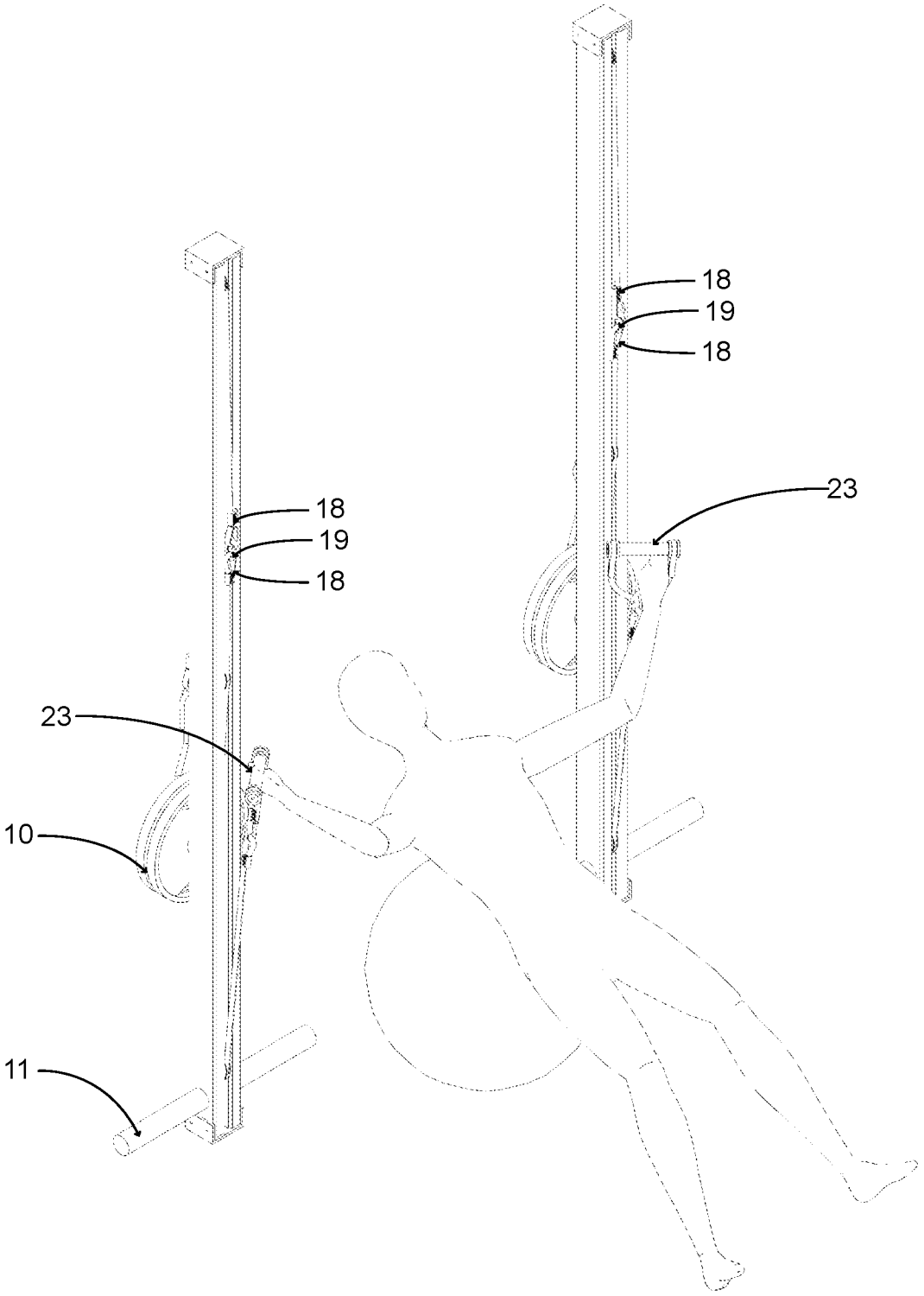
FIG. 20 is a diagram of a dual exercise system configuration performing a cable fly exercise with handle attachments according to embodiments of the present invention.

FIG. 20 shows a user performing an incline chest press exercise on an exercise ball with a pair of accessory handles 23 connected to lines of a pair of exercise devices which are parallel to each other according to embodiments of the present invention. By configuring a pair of exercise devices in close proximity to each other such as in a parallel configuration, additional exercises may be performed by the user. These may include but are not limited to for example: Incline Chest Press, Chest Press, Decline Chest Press, Shoulder Press, Alternating Shoulder Press, Squat, Alternating Squat and Dead Lift. In FIGS. 13, 14, 18 and 20, a combined line (e.g. made from one or more sub-lines, e.g. flexible lines 8A and 8C) has been threaded through the upper sheave, with a weight-attached at the end of the line hanging down from the upper sheave at the rear face of the vertical member. The combined line threaded from the upper sheave is then threaded in front of the middle sheave and then diagonally threaded between the sub-members and behind the lower sheave and then pulled towards the front face of the vertical member. The accessory handles may then be attached by carabiner to the end of the combined line which exits from the lower sheave.

Figure 21:
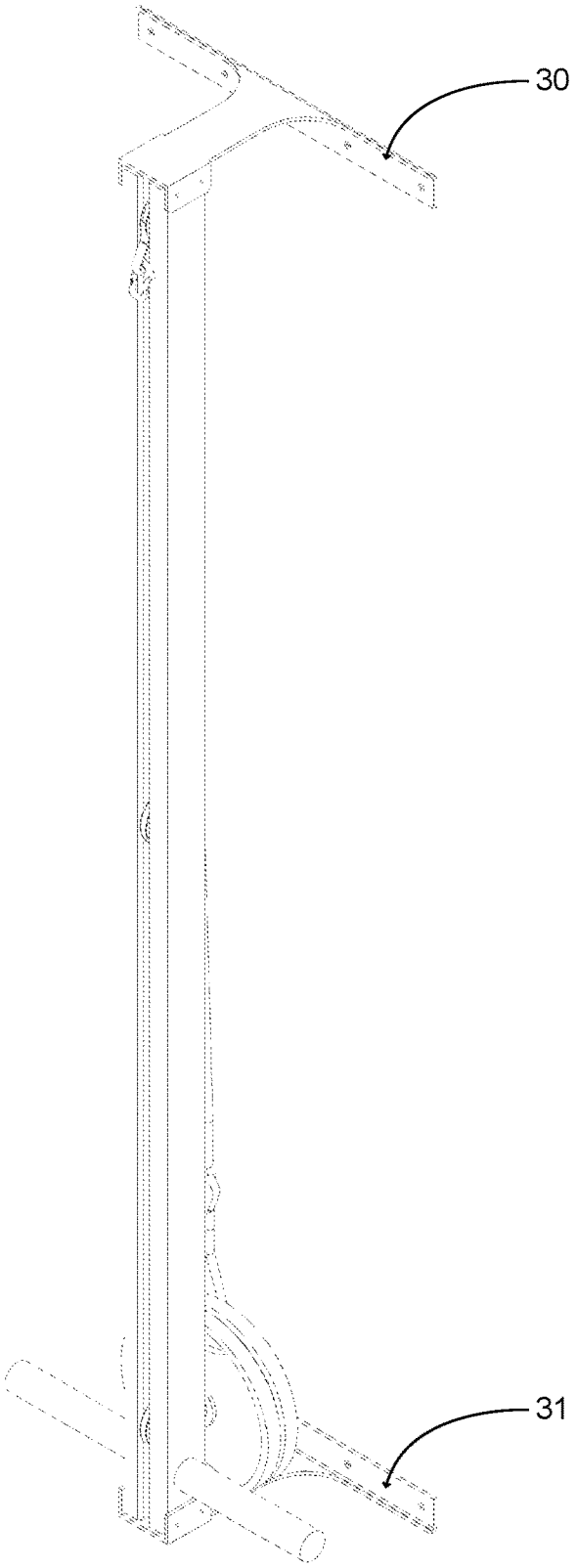
FIG. 21 is a diagram of an exercise system assembly according to embodiments of the present invention.

FIG. 21 is a diagram of an example alternate installation utilizing mechanical brackets which secure an example system to the wall in lieu of attachment to the floor and ceiling according to embodiments of the present invention. In this embodiment, an alternate ceiling bracket 30 and floor bracket 31 is used in place of bracket assembly 3 and 12.

Figure 22:
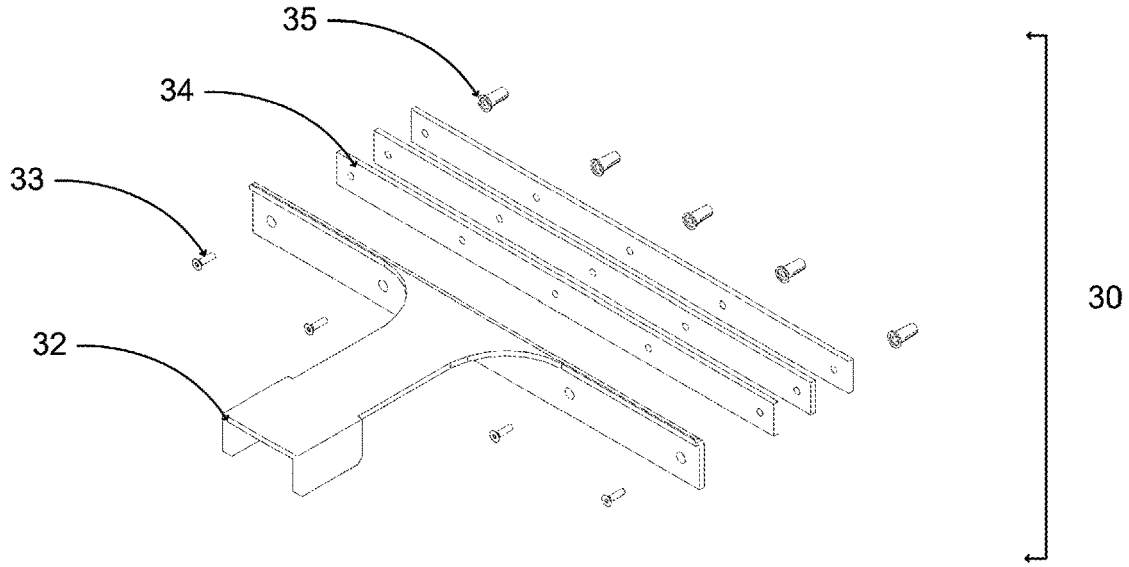
FIG. 22 is an exploded axonometric diagram of a upper wall mounting bracket of an alternate exercise system according to embodiments of the present invention.

FIG. 22 is an exploded axonometric diagram of an example upper wall mounting bracket 30 according to embodiments of the present invention. Bracket 30 may include a "T" shaped metal bracket which mechanically secures the vertical member 1, to the wall of the installation site by for example of mechanical screws 33 and anchors 35. Spacer blocks 34 can be used to provide lateral adjustments during the installation due to existing decorative trim, leaning walls or other conditions which do not easily allow the system to be installed in a proper vertical manner.

Figure 23:
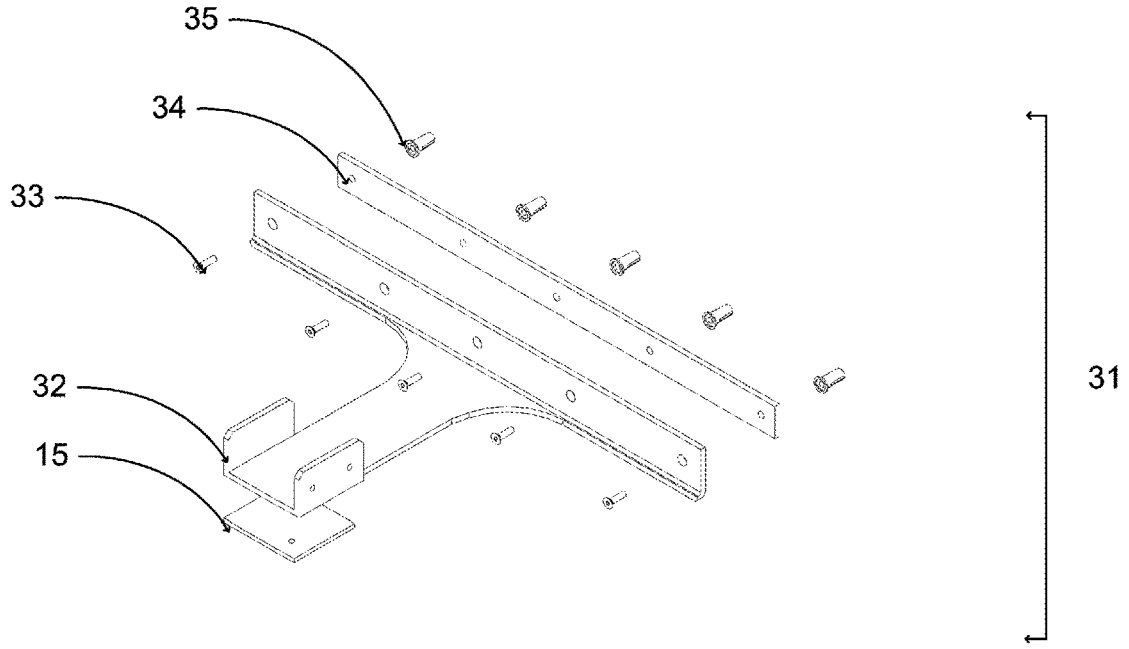
FIG. 23 is an exploded axonometric diagram of a lower wall mounting bracket of an alternate exercise system according to embodiments of the present invention.

FIG. 23 is an exploded axonometric diagram of an example lower wall mounting bracket 31 according to embodiments of the present invention. Bracket 31 may include a "T" shaped metal bracket which mechanically secures the vertical member 1, to the wall of the installation site by for example of mechanical screws 33 and anchors 35. Spacer blocks 34 can be used to provide lateral adjustments during the installation due to existing decorative trim, leaning walls or other conditions which do not easily allow the system to be installed in a proper vertical manner. Also shown is an isolation pad 15 of neoprene rubber or a similar material which may allow for the dead load of the system to rest on the floor of the installation site.

Figure 24:
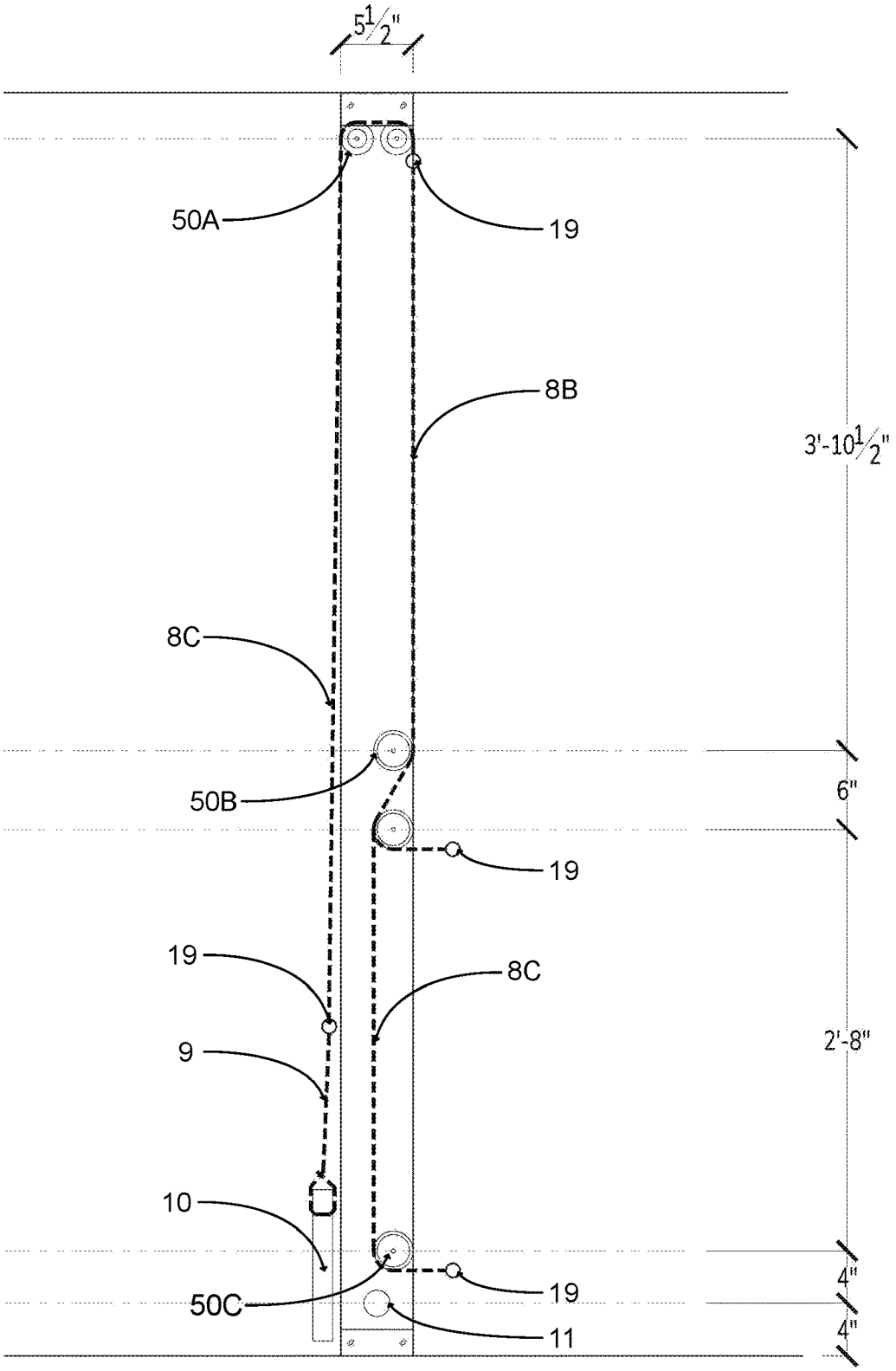
FIG. 24 is a section diagram of an example alternate sheave configuration of the exercise device utilizing additional sheaves according to embodiments of the present invention

FIG. 24 is a section diagram of an example alternate sheave configuration of the exercise device utilizing additional sheaves. FIG. 24 shows the primary flexible line 8A, running from the counterweight 10 connected to lanyard 9, threaded up to and through the upper sheave group 50A. Upper sheave group 50A may be disposed substantially at a third end near the ceiling of the vertical member 1, e.g. approximately (e.g. +−10%) 4% of the way from the top/ceiling end, or approximately 4 inch(es) from the ceiling. The sheave position is described with respect to the center of the sheave, each sheave may have varying diameters, where the position of the sheave may depend on its size and diameter, e.g. a sheave with a larger diameter may be disposed 10% of the way towards the lower/floor end of the device (e.g. approximately 10 inches). Upper sheave group 50A may have two or more horizontally placed sheaves positioned near or at the ceiling level of the vertical member 1. For example, the upper sheave group 50A may have two sheaves each with a diameter of 2". The two sheaves may be disposed substantially near the ceiling (e.g. 4" from the first end of the vertical member) on a piece of 1"×6" lumber (e.g. approximately 5.5" in nominal width). Each sheave in the example sheave group 50A may be mounted approximately 2" away from the center width of the 1"×6" lumber resulting in the sheaves being centered and disposed approximately ¾" from the front face and the rear face of the vertical member 1 as well as 4" apart from each other. Upper sheave group 50A may have sheaves relatively smaller in diameter than single sheave groups (e.g. sheave 5A). Upper sheave group 50A may position sheaves to reduce the frictional force of the flexible line 8A. For example, upper sheave group 50A may have sheaves placed at or beyond the front and back faces of the vertical member 1 (e.g. the sheaves extend to the limit of a front and rear face of the vertical members (e.g. flush with the limits of the device) or beyond the limit of a front and rear face of the vertical members) in order to reduce the frictional or drag force associated with the counterweight 10 traveling along the back face of the vertical member 1. In other embodiments, a guide may be used to ensure the flexible line is strung away from the back face of the vertical members to reduce the drag or frictional force of the counterweight rubbing against the vertical members.

Also shown is middle sheave group 50B which may have two or more vertically opposed sheaves positioned near or at the middle of the vertical member 1. Middle sheave group 50B may be disposed substantially near the middle or center of member 1 and may be placed approximately (e.g. +−10%) 50% of the way along member 1 from the upper sheave group 50A (e.g. approximately 3.875' along) in the direction towards the floor of the vertical member 1. Middle sheave group 50B may position sheaves to reduce the frictional force of flexible lines 8B or 8C. For example, in an embodiment with four sheaves, middle sheave group 50B may have a higher middle sheave positioned above a lower middle sheave wherein the upper middle sheave guides the flexible line 8B or 8C along the front face of the vertical members, preventing the flexible lines 8A or 8C from making contact and rubbing against the front face of the vertical member. The lower middle sheave 50B (e.g. a fourth sheave) may be placed below the higher middle sheave 50B and positioned, e.g. +−10% below the higher of the two middle sheaves, or e.g. 6" below the higher middle sheave. For example, a higher middle sheave may be directly centered and placed 50% from the bottom of a first end near the floor and may have a lower middle sheave placed 40% from the bottom of the first end near the floor. The higher middle sheave and/or lower middle sheave, when positioned closer together vertically may serve as a guide for the flexible line, preventing the flexible line from unseating from the U channel of the sheaves. Each of the middle sheaves 50B may also have a line threaded around it in order to hold the line at a certain position for an exercise (as with sheaves at the top and bottom of the device). In the case of an especially tall ceiling, the device may extend well beyond the upper sheave group 50A, the upper sheave group may extend further from the ceiling as described above, and the dimensions described above may be relative to some upper limit below the height of the ceiling.

Lower sheave group 50C may be a single sheave or a group of sheaves. For example, a flexible line (e.g. flexible line 8A connected to 8C) may be threaded around the upper sheave group 50A and may then be threaded in front of the higher middle sheave, providing support and reducing the frictional forces of the flexible lines on the front face of the vertical member. The flexible line may then be threaded diagonally between the sub-members behind the lower middle sheave. The flexible line may then be threaded vertically down between the sub-members 1 and behind the lower sheave group 50C. Lower sheave group 50C may be disposed substantially at a first end near the floor of the vertical member 1, e.g. approximately (e.g. +−10%) 8% of the way above the lower end of the first end near the floor, or approximately 8 inch(es) from the floor. The sheave position is described with respect to the center of the sheave, each sheave may have varying diameters, where the position of the sheave may depend on its size and diameter, e.g. a sheave with a larger diameter may be disposed 10% of the way towards the floor (e.g. approximately 10 inches). The lower sheave group 50C may be placed approximately (e.g. +−10%) 40% below the lower middle sheave (e.g. approximately 2.67').

While the invention has been described with respect to a limited number of embodiments, these should not be construed as limitations on the scope of the invention, but rather as exemplifications of some of the preferred embodiments. Other possible variations, modifications, and applications are also within the scope of the invention. Different embodiments are disclosed herein. Features of certain embodiments may be combined with features of other embodiments; thus certain embodiments may be combinations of features of other embodiments.

What is claimed is:

1. An exercise device comprising:

a vertically oriented member comprising two sub-members;

a first sheave disposed substantially at a first end of the member;

a second sheave disposed substantially at a second end of the member;

a third sheave disposed substantially at a center of the member, wherein the first sheave, second sheave, and third sheave are mounted between the two sub-members; and a flexible line connected to a free weight at one end of the line via a lanyard, and threaded through at least one sheave of the first, second, and third sheaves, the lanyard travelling between the two sub-members and guiding the free weight;

wherein the first, second, and third sheaves are mounted such that the first, second, and third sheaves extend to a limit or less than the limit of at least a front and rear face of the vertically oriented member.

2. The device of claim 1, wherein at least one of the first sheave, second sheave, and third sheave further comprises a group, the group comprising at least two or more sheaves.

3. The device of claim 2, wherein the third sheave comprises the group, wherein the at least two or more sheaves of the group comprise two or more vertically opposed sheaves.

4. The device of claim 1, wherein the flexible line comprises a plurality of flexible lines connected end to end.

5. The device of claim 1, wherein the flexible line runs from the free weight at one end of the member to the second sheave disposed at the second end of the member.

6. The device of claim 1, wherein the sheaves are configured to prevent the flexible line from contacting the front face or the rear face of the vertically oriented member.

7. The device of claim 1, wherein the vertically oriented members are made primarily of wood.

8. The device of claim 1, wherein disposed at one of the first end or the second end of the vertical member is a foot support.

9. A method for cable-based exercises performed using a pulley device, the method comprising:

connecting a counterweight to a first line;

selecting a second length of line, among a set of different length lines, for the cable-based exercise; and running the second line through pulleys of the pulley device for the cable-based exercise, the pulleys comprising at least three pulleys.

10. The method of claim 9, wherein selecting the second length of line comprises connecting two lines together.

11. The method of claim 9, wherein the second line is connected to an accessory handle, wherein the accessory handle is an interchangeable attachment.

12. The method of claim 11, wherein the second line connected to the accessory handle is pulled to perform exercises.

13. An exercise device comprising:

two parallel vertically oriented members;

a first pulley fixed substantially near an upper end of the members, in-between the members;

a second pulley fixed substantially near a lower end of the members, in-between the members;

a third pulley fixed substantially in a middle region of the members, in-between the members; and a rope fixed to a free weight at a first end via a lanyard, threaded through at least the first pulley of the first pulley, the second pulley, and the third pulley, and connected to a handle at a second end, such that the free weight hangs from a pulley of the first pulley, the second pulley, and the third pulley on one side of the device, the lanyard travels between the two members and guiding the free weight, and the handle is connected to the line exiting a pulley of the first pulley, the second pulley, and the third pulley on another side of the device, wherein the first, second, and third pulleys are mounted such that the first, second, and third pulleys extend to a limit or less than the limit of at least a front and rear face of the vertically oriented members.

14. The exercise device of claim 13, wherein at least one of the first pulley, second pulley, and third pulley further comprises of a group, the group comprising at least two or more pulleys.

15. The exercise device of claim 13, wherein the rope comprises a plurality of ropes connected end to end.

16. The exercise device of claim 13, wherein the parallel vertically oriented members comprise primarily wood.

* * * * *